US009266318B2

(12) United States Patent
Miller

(10) Patent No.: US 9,266,318 B2
(45) Date of Patent: Feb. 23, 2016

(54) PRINTING SYSTEM WITH RETRACTABLE SCREEN ASSEMBLY

(71) Applicant: Nike, Inc., Beaverton, OR (US)

(72) Inventor: Todd W. Miller, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 356 days.

(21) Appl. No.: 13/874,672

(22) Filed: May 1, 2013

(65) Prior Publication Data

US 2014/0326153 A1 Nov. 6, 2014

(51) Int. Cl.

| | |
|---|---|
| ***B41J 29/12*** | (2006.01) |
| ***B41F 17/00*** | (2006.01) |
| ***B41J 3/407*** | (2006.01) |
| ***B41J 11/00*** | (2006.01) |
| ***A43B 3/00*** | (2006.01) |
| ***A43D 8/22*** | (2006.01) |

(52) U.S. Cl.

CPC ..... *B41F 17/00* (2013.01); *A43B 3/0078* (2013.01); *A43D 8/22* (2013.01); *B41J 3/4073* (2013.01); *B41J 3/4078* (2013.01); *B41J 11/002* (2013.01); *B41J 29/12* (2013.01)

(58) Field of Classification Search

CPC ..... B41F 17/00; B41J 3/4073; B41J 3/4078; B41J 11/002; B41J 29/12; A43D 8/22; A43B 3/0078

USPC ..... 101/480, 424.1, 487, 488, 35

See application file for complete search history.

(56) References Cited

U.S. PATENT DOCUMENTS

| | | | | |
|---|---|---|---|---|
| 3,726,589 | A * | 4/1973 | Difulvio et al. | 355/64 |
| 5,059,359 | A | 10/1991 | Hull et al. | |
| 5,086,700 | A * | 2/1992 | Van Den Berg | 101/424.1 |
| 5,129,161 | A * | 7/1992 | Szarka | 34/277 |
| 5,137,662 | A | 8/1992 | Hull et al. | |
| 5,184,307 | A | 2/1993 | Hull et al. | |
| 5,188,352 | A | 2/1993 | Bartman et al. | |
| 5,345,391 | A | 9/1994 | Hull et al. | |
| 5,758,889 | A * | 6/1998 | Ledakis | 280/47.38 |
| 5,832,362 | A | 11/1998 | Trokhan | |
| 5,962,860 | A | 10/1999 | Trokhan et al. | |
| 6,271,532 | B1 | 8/2001 | Trokhan et al. | |
| 6,350,071 | B1 | 2/2002 | Conwell et al. | |
| 6,543,890 | B1 * | 4/2003 | Ylitalo et al. | 347/102 |
| 7,445,441 | B2 | 11/2008 | West et al. | |
| 7,770,519 | B2 | 8/2010 | Schmitt et al. | |
| 2001/0019351 | A1 * | 9/2001 | Fujishiro | 347/212 |

(Continued)

FOREIGN PATENT DOCUMENTS

| | | |
|---|---|---|
| JP | 2003320697 | 11/2003 |
| WO | 2005/076730 A2 | 8/2005 |

OTHER PUBLICATIONS

International Search Report and Written Opinion mailed Sep. 2, 2014 in PCT/US2014/035218.

(Continued)

*Primary Examiner* — Leslie J Evanisko

(74) *Attorney, Agent, or Firm* — Plumsea Law Group, LLC

(57) ABSTRACT

A printing assembly includes a printing device and a retractable screen assembly that blocks UV light. As the printing device moves across a platform, the retractable screen assembly may fasten to support members, thereby causing a screen member to extend from the retractable screen assembly and prevent UV light from traveling along a range of viewing angles.

21 Claims, 21 Drawing Sheets

(56) References Cited

U.S. PATENT DOCUMENTS

| | | | |
|---|---|---|---|
| 2007/0070162 | A1 | 3/2007 | Yokoyama |
| 2010/0242753 | A1 | 9/2010 | Gygi |
| 2011/0007119 | A1 | 1/2011 | Baba et al. |
| 2011/0298877 | A1 | 12/2011 | Blessing |
| 2012/0154495 | A1 | 6/2012 | Edwards |
| 2013/0209939 | A1 * | 8/2013 | Recchia et al. ..... 430/296 |

OTHER PUBLICATIONS

International Preliminary Report on Patentability (including Written Opinion of the ISA) issued Nov. 3, 2015 in International Application No. PCT/US2014/035218.

* cited by examiner

PRINTING SYSTEM WITH RETRACTABLE SCREEN ASSEMBLY

BACKGROUND

The present embodiments relate generally to a flexible manufacturing system for printing to articles. Flexible manufacturing systems can be utilized to print onto articles during manufacturing of an article, or after an article has been manufactured, for example, by printing onto articles at a retail location.

SUMMARY

In one aspect, a printing assembly includes a printing device, a retractable screen assembly fastened to the printing device. The retractable screen assembly further includes a housing member and a screen member that can extend from and retract into the housing member. The screen member can extend from the housing member while the printing device is in use.

In another aspect, a flexible manufacturing system includes a printing assembly with a printing device and a retractable screen assembly. The retractable screen assembly further includes a housing member fastened to the printing device and a screen member that can extend from and retract into the housing member. A support member is disposed adjacent to the printing assembly, where the printing assembly is configured to move relative to the support member. A portion of the screen member can be releasably fastened to the support member.

In another aspect, a flexible manufacturing system includes a printing assembly with a printing device and a retractable screen assembly. The retractable screen assembly further includes a housing member fastened to the printing device and a screen member that can extend from and retract into the housing member. A support member is disposed adjacent to the printing assembly, where the printing assembly is configured to move relative to the support member. A portion of the screen member can automatically fasten to the support member when the printing device is moved directly adjacent to the support member and while the screen member is retracted within the housing. The screen member extends from the housing as the printing device is moved away from the support member and while the portion remains fastened to the support member.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
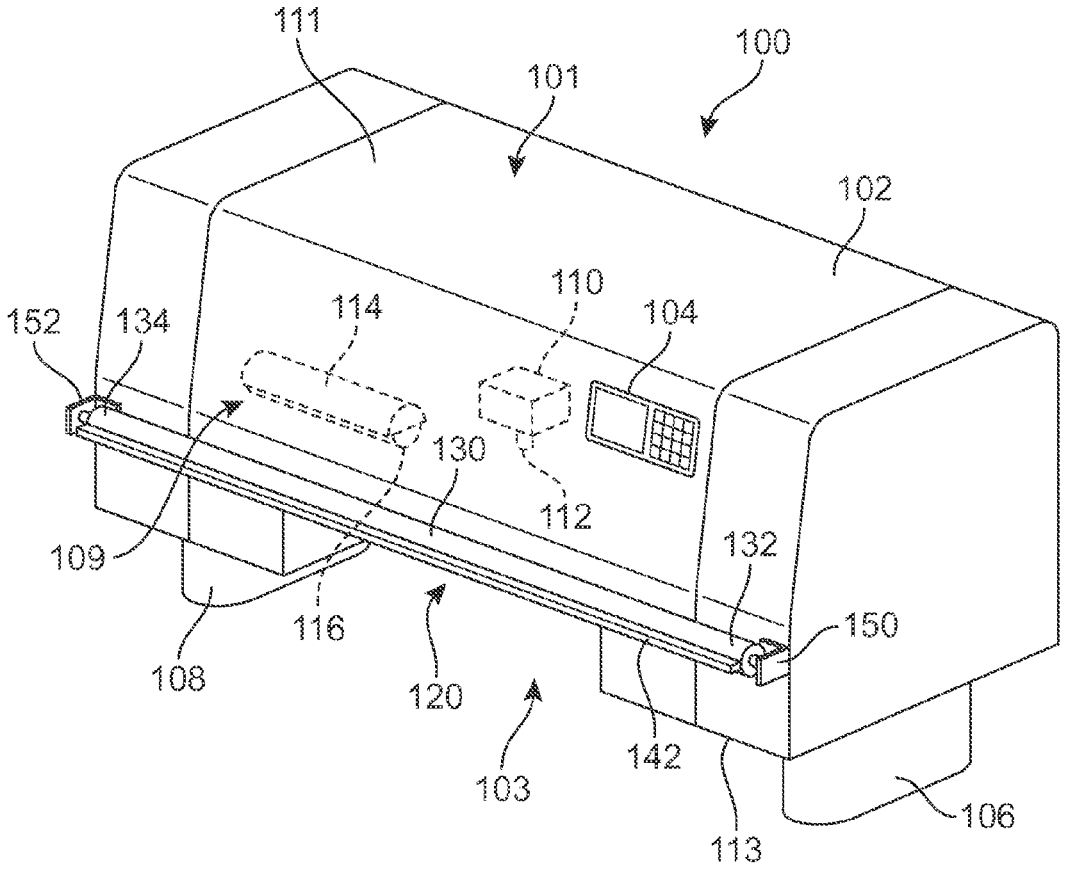
FIG. 1 is a schematic isometric view of an embodiment of a printing assembly.

FIG. 1 illustrates a schematic isometric view of an embodiment of printing assembly 100. Printing assembly 100, along with additional components of a printing station 300 (shown in FIG. 3), may together comprise a flexible manufacturing system that is configured to apply various graphics, or any type of design or image, to articles of footwear and/or apparel. Moreover, the process of applying graphics may occur during manufacturing and/or after an article has been manufactured. For example, graphics may be applied to an article of footwear after the article of footwear has been manufactured into a three-dimensional form including an upper and sole structure.

The term "graphic" as used throughout this detailed description and in the claims refers to any visual design elements including, but not limited to: photos, logos, text, illustrations, lines, shapes, images of various kinds as well as any combinations of these elements. Moreover, the term graphic is not intended to be limiting and could incorporate any number of contiguous or non-contiguous visual features. For example, in one embodiment, a graphic may comprise a logo that is applied to a small region of an article of footwear. In another embodiment, a graphic may comprise a large region of color that is applied over one or more regions of an article of footwear.

For clarity, the following detailed description discusses an exemplary embodiment, in which a flexible manufacturing system (comprising printing assembly 100 as well as possibly additional components) is used to apply graphics to an article of footwear. Generally, the flexible manufacturing system can be used with any other kinds footwear including, but not limited to: hiking boots, soccer shoes, football shoes, sneakers, rugby shoes, basketball shoes, baseball shoes, running shoes as well as other kinds of shoes. While the exemplary embodiments show a single article, it will be understood that a flexible manufacturing system could be used to apply graphics to two or more articles, including articles that make up a pair of footwear.

A flexible manufacturing system, including printing assembly 100 as well as possibly other components, need not be limited to use with articles of footwear and the principles taught throughout this detailed description may be applied to additional articles as well. Generally, these principles could be applied to any article kinds of articles. Examples of articles that can be used with the flexible manufacturing system include, but are not limited to: footwear, gloves, shirts, pants, socks, scarves, hats, jackets, as well as other articles. Other examples of articles that may be used include, but are not limited to: shin guards, knee pads, elbow pads, shoulder pads, as well as any other type of protective equipment. Additionally, in some embodiments, the article could be another any other type of article, including, but not limited to: balls, bags, purses, backpacks, as well as other article. Moreover, the article may be any article that can be worn or may be an article that is not generally worn.

In some embodiments, printing assembly 100 may include printing device 101. Printing device 101 may be any kind of printer utilizing any kind of printing technique known in the art. These printing techniques can include, but are not limited to: toner-based printing, liquid inkjet printing, solid ink printing, dye-sublimation printing, inkless printing (including thermal printing and UV printing), MEMS jet printing technologies as well as any other methods of printing. In some cases, printing device 101 may make use of a combination of two or more different printing techniques. The type of printing technique used may vary according to factors including, but not limited to: material of the target article, size and/or geometry of the target article, desired properties of the printed image (such as durability, color, ink density, etc.) as well as printing speed, printing costs and maintenance requirements.

In one embodiment, printing device 101 may utilize an inkjet printer in which ink droplets may be sprayed onto a substrate, such as the medial or lateral side panel of a formed upper. Using an inkjet printer allows for easy variation in color and ink density. This arrangement also allows for some separation between the printer head and the target object, which can facilitate printing directly to objects with some curvature and/or surface texture.

Printing device 101 may include casing 102 that encloses various components of printing device 101. Printing device 101 may include a top portion 111 and a bottom portion 113. In some embodiments, casing 102 may be shaped to include an opening 103 that is formed along bottom portion 113. Opening 103 may be an open region, or bay, of printing device 101 where an article, such as an article of footwear, may be received for printing. The size and/or shape of opening 103 may vary in different embodiments according to the type of articles being used, as well as according to other factors.

Printing device 101 may include print head 110, which is shown in phantom in FIG. 1. Print head 110 is shown here schematically as a single print head, including a single nozzle 112, but it will be understood that embodiments can incorporate multiple print heads. The size, shape, number and type of print heads used may be selected according to the printing technique, for example.

Some embodiments may include provisions for curing inks applied by print head 110. In some embodiments, for example, UV (ultra-violet) curing may be used to cure printed inks and/or other materials. A variety of printing techniques that utilize UV curing of inks or other printing materials are known in the art.

In embodiments utilizing UV curing techniques, printing device 101 may further include a UV light source 114. For purposes of illustration, UV light source 114 is shown here schematically. In this embodiment, UV light source 114 may further include UV bulb 116. Various types of UV light sources could be used including black light type UV lamps, short wave UV lamps, gas-discharge lamps, ultraviolet LEDs, ultraviolet lasers, as well as possibly other kinds of UV generating technologies.

It will be understood that the relative locations of UV light source 114 and print head 110 are only intended to be exemplary, and in general the relative locations of these components within casing 102 may be selected to achieve desired curing results. In some embodiments, for example, UV light source 114 may be positioned so that UV radiation does not impinge on ink within print head 110.

Figure 3:
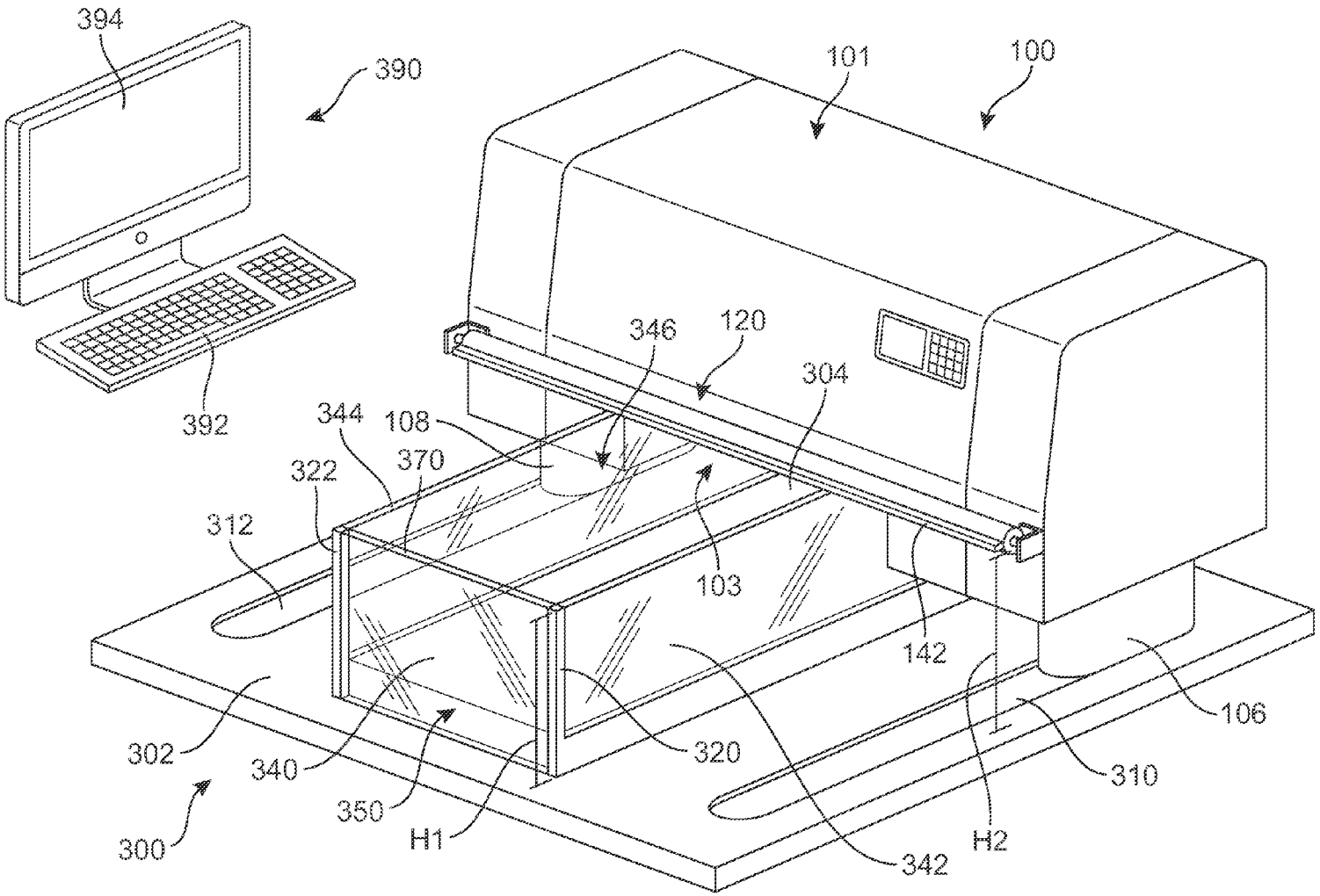
FIG. 3 is a schematic isometric view of an embodiment of a printing station and an associated computing system.

In some embodiments, printing device 101 may include one or more legs. For example, printing device 101 can include first leg 106 and second leg 108. In some embodiments, first leg 106 and second leg 108 support printing device 101 in a manner that allows printing device 101 to be translated across a table, surface or other structure. In some embodiments, first leg 106 and second leg 108 may engage tracks in a table such that printing device 101 may be translated along the tracks. Such a configuration is shown in FIG. 3 and described in further detail below.

In some embodiments, printing assembly 100 may include a UV blocking component, such as a wall, screen or similar provision which may act to block the transmission of UV light in the region outside of printing device 101. In some embodiments, printing assembly 100 can include a UV screen. A UV screen may be used to block the transmission of UV light, especially in the vicinity of opening 103.

Some embodiments of printing device 101 may include control panel 104. In some embodiments, control panel 104 may include various buttons and/or displays that allow a user to interface with printing device 101 for purposes of printing, maintenance or any other purposes.

Figure 2:
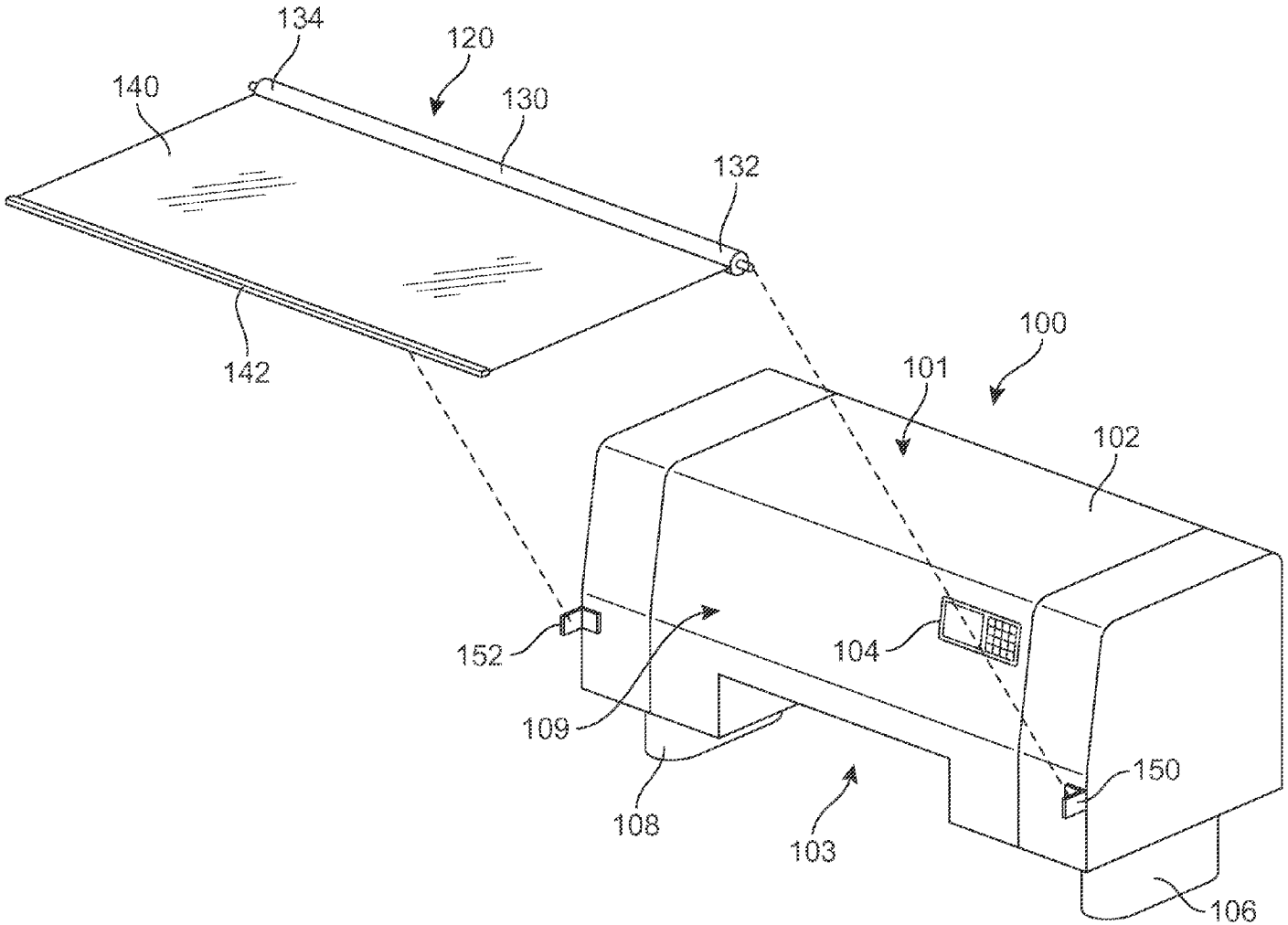
FIG. 2 is a schematic isometric view of an embodiment of a retractable screen assembly separated from a printing device.

FIG. 2 illustrates another schematic isometric view of an embodiment of printing assembly 100. Referring now to FIGS. 1 and 2, printing assembly 100 may include provisions for adjusting the area spanned by a UV protective screen in order to accommodate changes in the position of printing device 101 during printing. In some embodiments, printing assembly 100 may include a retractable screen assembly 120. As described in further detail below, retractable screen assembly 120 may be configured with a retractable screen that allows the area covered by the UV protective screen to be increased or decreased.

In some embodiments, retractable screen assembly 120 may comprise a housing member 130. Housing member 130 may comprise a tube-like member that extends from a first end portion 132 to a second end portion 134. In some embodiments, housing member 130 may extend along the length of printing device 101. However, in other embodiments, the length of housing member 130 could be more or less than the length of printing device 101.

Retractable screen assembly 120 may also include screen member 140. In some embodiments, screen member 140 may be a substantially two dimensional member, with the length and width substantially greater than its thickness. In other embodiments, however, the geometry of screen member 140 could vary. In some cases, the geometry of screen member 140 may vary according to the materials used for screen member 140.

Screen member 140 may be flexible. This allows screen member 140 to be retracted within housing member 130. In some embodiments, the flexibility of screen member 140 can be selected to ensure that screen member 140 can be rolled up within housing member 130.

Generally, screen member 140 may comprise a protective material. In some embodiments, screen member 140 may be a UV light protective material that blocks and/or absorbs UV radiation and thereby prevents the transmission of UV radiation through screen member 140. Various different materials, including various kinds of films, which include UV protective layers, can be used to manufacture screen member 140. Furthermore, screen member 140 may be transparent or may have any other opacity according to the type of materials used.

Screen member 140 may generally be configured to retract into housing member 130. In some embodiments, screen member 140 may be wound around a central rod or similar component that extends through the center of housing member 130. Furthermore, screen member 140 may be attached to housing member 130 in such a way that screen member 140 is generally spring biased towards retracting (or rolling up) within housing member 130. This biasing force may be overcome by pulling screen member 140 so that it extends from housing member 130.

To accommodate retractable screen assembly 120, printing device 101 may be configured with one or more fasteners. In some embodiments, printing device 101 includes first fastener 150 and second fastener 152. First fastener 150 and second fastener 152 may be used to attach first end portion 132 and second end portion 134 of housing member 130 to printing device 101. Generally, any kinds of fasteners could be used including, but not limited to: brackets, braces, as well as other kinds of fasteners. In some embodiments, fasteners for engaging retractable screen assembly 120 may be integrally formed with casing 102 of printing device 101.

In some embodiments, retractable screen assembly 120 may be positioned adjacent to opening 103 on front face 109 of printing device 101. In some embodiments, retractable screen assembly 120 may be positioned between top portion 111 of printing device 101 and opening 103. In other words, retractable screen assembly 120 may be positioned just above opening 103. This location may allow screen member 140 to provide UV protection along various viewing angles of opening 103 when screen member 140 is extended from housing 130, while preventing interference between retractable screen assembly 120 and articles entering opening 103. In other embodiments, however, it should be understood that retractable screen assembly 120 could be attached to any other portion of printing device 101.

In some embodiments, one or more edges of screen member 140 may be reinforced. In one embodiment, screen member 140 may be reinforced at edge portion 142. In some embodiments, edge portion 142 comprises a distinct material portion that is connected with the edge of screen member 140. In other embodiments, edge portion 142 is integrally formed with screen member 140, and could comprise a region of increased material thickness, for example.

FIG. 3 is a schematic isometric view of an embodiment of a printing station 300. Printing station 300 may comprise printing assembly 100 along with additional components that facilitate printing onto various kinds of articles. In some embodiments, printing station 300 may include table 302, which supports printing assembly 100 as well as other components.

Figure 4:
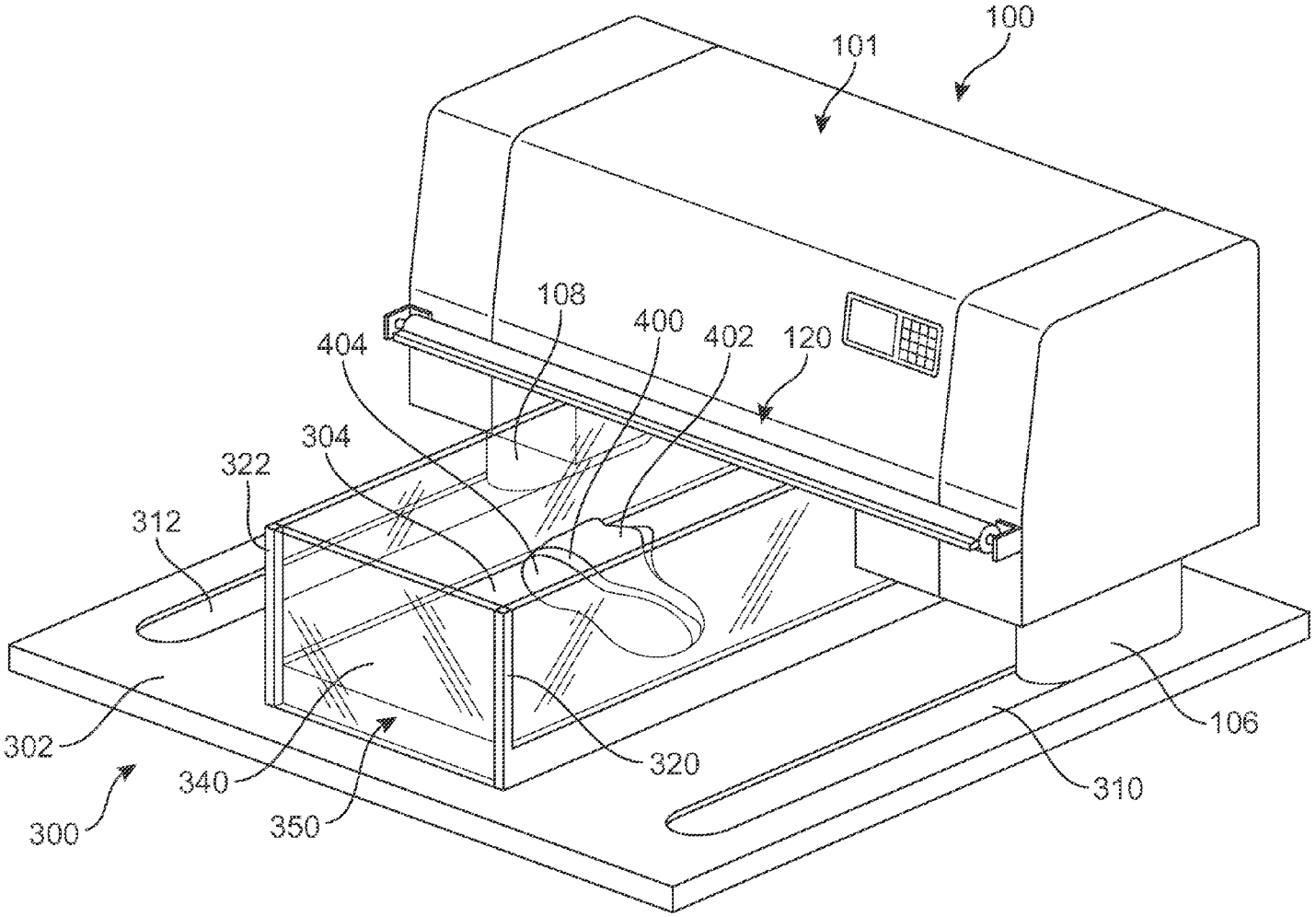
FIG. 4 is a schematic isometric view of the printing station of FIG. 3, in which an article is placed on a platform.

Printing station 300 may include platform 304. In some embodiments, articles configured for printing may be placed directly onto platform 304, as shown in FIG. 4. In other embodiments, however, articles can be associated with a holding device, fixture or other device for holding an article in a particular position and/or orientation on platform 304.

Figure 6:
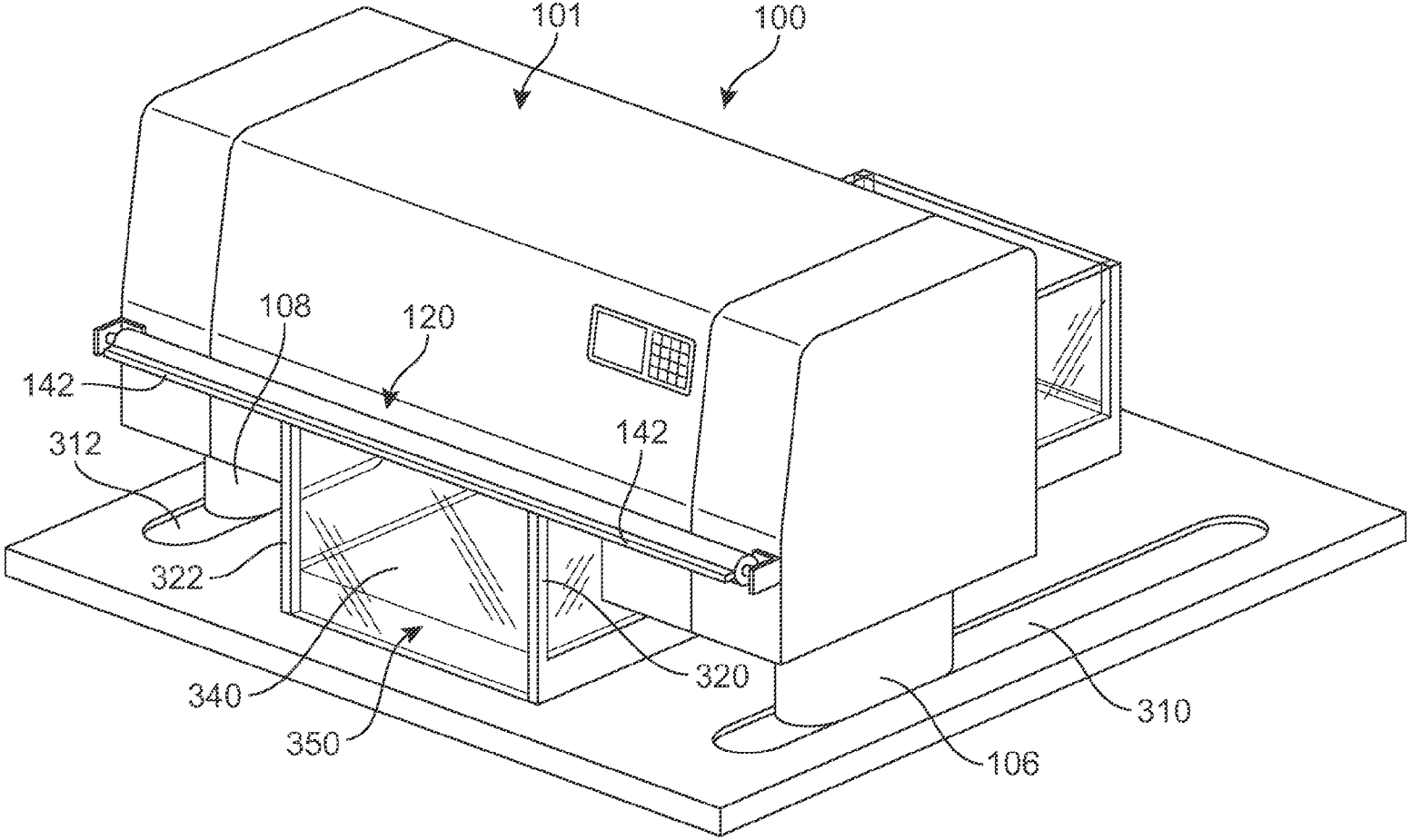
FIG. 6 is a schematic isometric view of the printing station of FIG. 3, in which a printing assembly has moved to a forward most position.

In some embodiments, table 302 may include first track 310 and second track 312 that receive first leg 106 and second leg 108, respectively, of printing device 101. This arrangement allows printing device 101 to translate along table 302 between a rearwards position and a forwards position. In the rearwards position, which is shown in FIG. 3, printing device 101 is generally not actively printing to an article. However, once printing device 101 has moved to the forwards position (as shown in FIG. 6), or to an intermediate position between rearwards position and forwards position, printing device 101 may actively print to an article disposed on platform 304.

Some embodiments may include provisions for blocking UV light along the perimeter of platform 304. In some embodiments, platform 304 may be configured with front wall 340, first side wall 342 and second side wall 344. Front wall 340, first side wall 342 and second side wall 344 may be configured as a rectangular enclosure that bounds platform 304. In some embodiments, front wall 340, first side wall 342 and second side wall 344 are arranged to that an upper opening 346 is formed along the top edges of the walls. Moreover, this enclosure may generally bound platform 304 from front portion 350 of platform 304 towards a rearward portion of platform 304. As seen in the Figures, in some embodiments portions of first side wall 342 and second side wall 344 may pass through opening 103 of printing device 101 to avoid any interference between first side wall 342, second side wall 344 and printing device 101.

In some cases, each of front wall 340, first side wall 342 and second side wall 344 may be made of a UV protective material, including any of the materials discussed above for screen member 140. In the current embodiment, front wall 340, first side wall 342 and second side wall 344 are shown as substantially transparent, however in other embodiments these walls could be substantially opaque.

In some embodiments, printing station 300 may include one or more support members that may interact with retractable screen assembly 120. In some embodiments, printing station 300 may include first support member 320 and second support member 322. First support member 320 and second support member 322 may extend vertically along the corners of platform 304.

In some embodiments, first support member 320 and second support member 322 may comprise posts that engage edge portion 142 of screen member 140. In other embodiments, however, a support member could take the form of any other structure, including, for example, a wall or other elongated structure.

In some embodiments, the heights of first support member 320 and second support member 322 may be approximately similar to the height of retractable screen assembly 120. For example, first support member 320 and second support member 322 have a height H1 above table 302, while retractable screen assembly 120 may be disposed a height H2 above table 302. In some embodiments, height H1 and height H2 may be substantially equal. In other embodiments, however, height H1 could be substantially greater than height H2. In still other embodiments, height H1 could be substantially less than height H1.

First support member 320 and second support member 322 may also provide structural support for front wall 340, first side wall 342 and second side wall 344. For example, first support member 320 may be used to join first side wall 342 and front wall 340 along a corner. Likewise, second support member 322 may be used to join second side wall 344 and front wall 340 along a corner. In some embodiments, first support member 320, second support member 322 and front wall 340 may collectively comprise an upper edge 370 that may interact with and support edge portion 142 of screen member 140.

In some embodiments, printing station 300 may be further associated with computing system 390. The term "computing system" refers to the computing resources of a single computer, a portion of the computing resources of a single computer, and/or two or more computers in communication with one another. Any of these resources can be operated by one or more users. In some embodiments, computing system 390 can include user input device 392 that allows a user to interact with computing system 390. Likewise, computing system 390 may include display 394. In some embodiments, computing system 390 can include additional provisions, such as a data storage device (not shown). A data storage device could include various means for storing data including, but not limited to: magnetic, optical, magneto-optical, and/or memory, including volatile memory and non-volatile memory. These provisions for computing system 390, as well as possibly other provisions not shown or described here, allow computing system 390 to communicate with and/or control various components of printing station 300. For example, computing system 390 may be used to: create and/or manipulate graphics for printing as well as controlling the operation of printing device 101.

For purposes of facilitating communication between various components of a flexible manufacturing system (including computing system 390 and printing device 101) can be connected using a network of some kind. Examples of networks include, but are not limited to: local area networks (LANs), networks utilizing the Bluetooth protocol, packet switched networks (such as the Internet), various kinds of wired networks as well as any other kinds of wireless networks. In other embodiments, rather than utilizing an external network, one or more components (i.e., printing device 101) could be connected directly to computing system 390, for example, as peripheral hardware devices.

Referring to FIG. 4, an article of footwear 400 has been placed on platform 304 in preparation for printing. In this embodiment, article of footwear 400, also referred to simply as article 400, includes upper 402 and sole structure 404. With article 400 disposed on platform 304, printing assembly 100 may be moved along table 302 so that printing device 101 can apply a graphic to upper 402.

Figure 5:
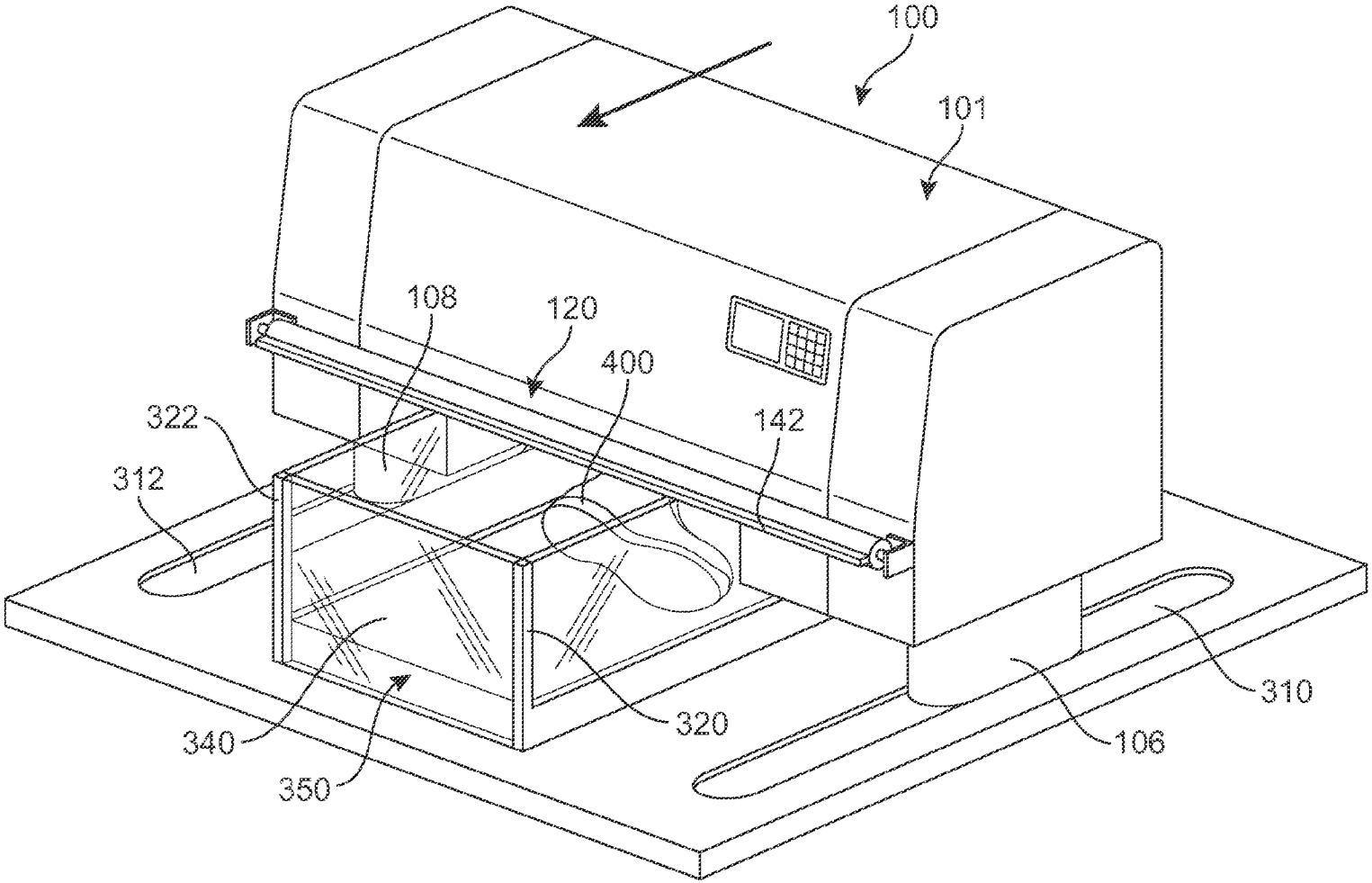
FIG. 5 is a schematic isometric view of the printing station of FIG. 3, in which a printing assembly has moved forwards.

FIGS. 5-11 illustrate an embodiment of a sequence of operation for printing station 300. Referring first to FIG. 5, printing assembly 100 may be moved towards the front portion 350 of platform 304. As previously discussed, printing assembly 100 may move along first track 310 and second track 312. In preparation for printing, printing assembly 100 may travel to a forward most position, as seen in FIG. 6. In this forward most position, retractable screen assembly 120 may engage first support member 320 and second support member 322. In particular, edge portion 142 of screen member 140 may automatically fasten to first support member 320 and second support member 322.

Different embodiments could utilize various techniques for automatically fastening edge portion 142 to first support member 320 and second support member 322. In some embodiments, magnetism may be used to fasten edge portion 142 to first support member 320 and second support member 322. In other embodiments, edge portion 142 may be mechanically fastened to first support member 320 and second support member 322. In other embodiments, still other methods of fastening edge portion 142 to first support member 320 and second support member 322 are possible.

Figure 7:
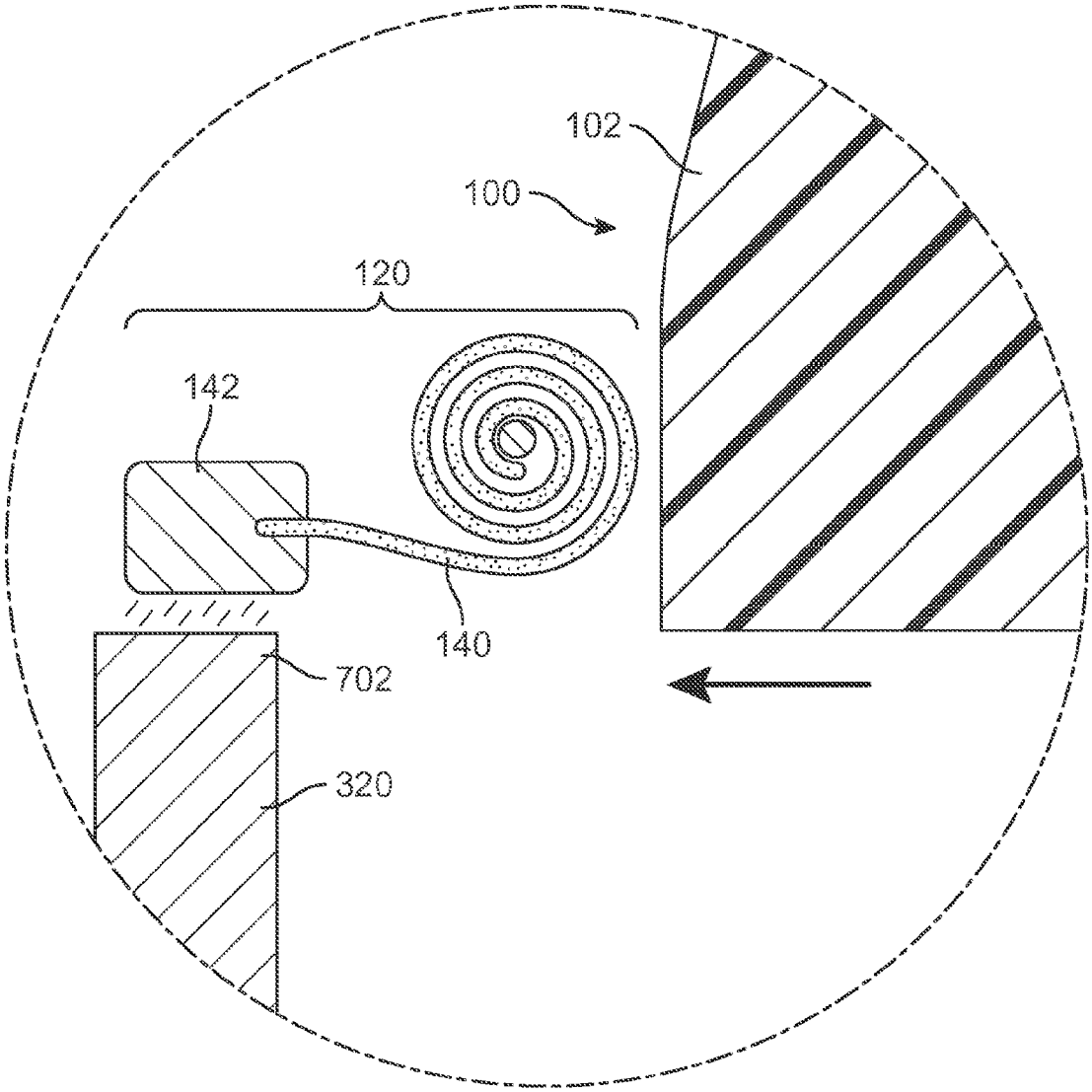
FIG. 7 is a schematic cross-sectional view of an embodiment of an edge portion of a screen member connecting to a support member.
Figure 8:
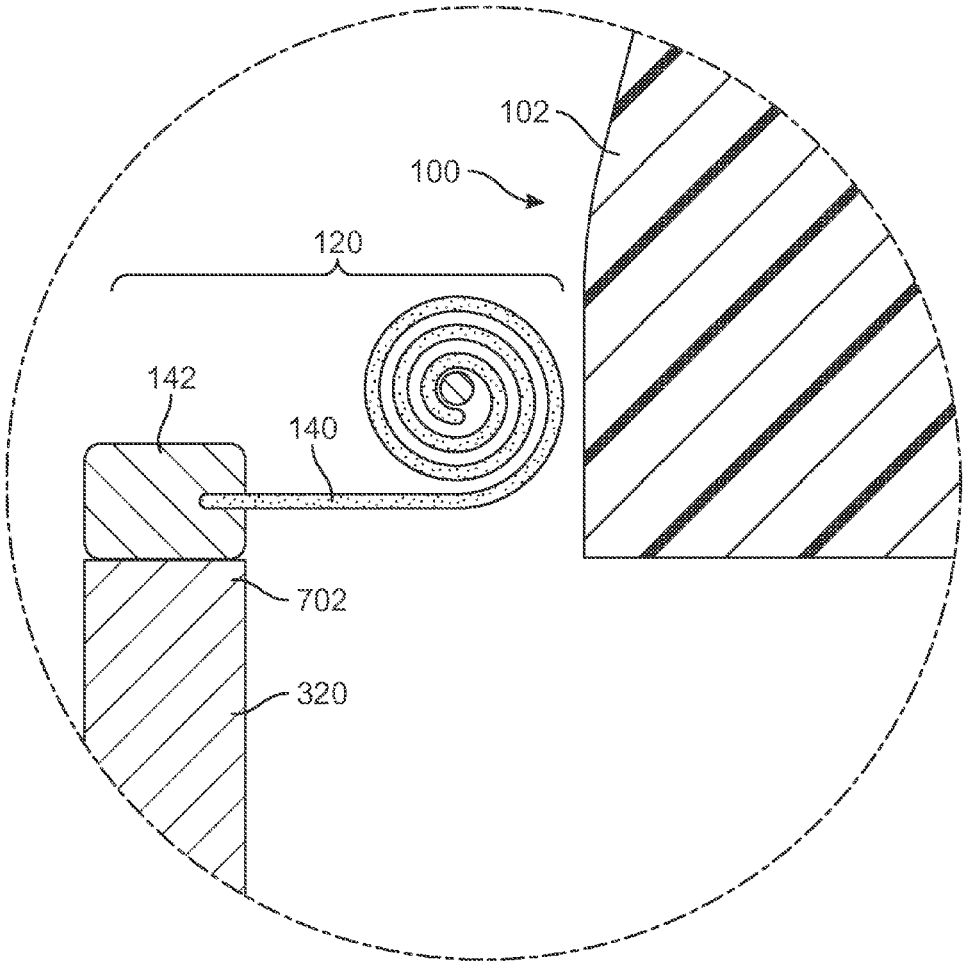
FIG. 8 is a schematic cross-sectional view of an embodiment of an edge portion of a screen member connecting to a support member.
Figure 9:
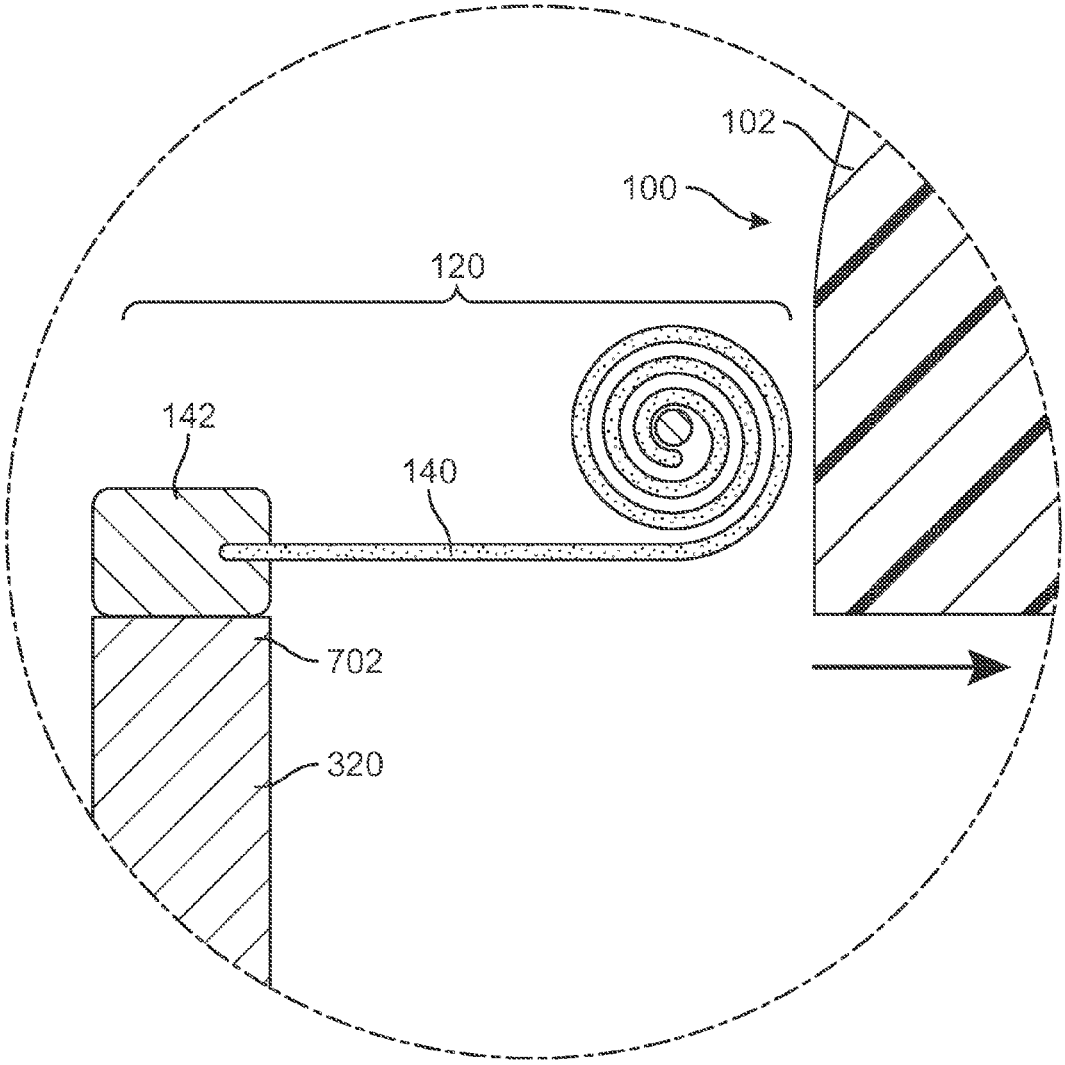
FIG. 9 is a schematic cross-sectional view of an embodiment of a screen member fastened to a support member.

FIGS. 7 through 9 illustrate cross-sectional schematic views of one possible mechanism for automatically fastening edge portion 142 of screen member 140 to first support member 320. In the embodiment of FIGS. 7 through 9, screen member 140 may be automatically fastened to first support member 320 (as well as second support member 322) using a magnetic fastening system. In particular, edge portion 142 of screen member 140 may comprise a magnetic material while top portion 702 of first support member 320 may comprise a metallic material that feels magnetic forces in the vicinity of a magnetic field. Likewise, second support member 322 may include a portion that is susceptible to magnetic forces. With this arrangement, as retractable screen assembly 120 approaches first support member 320, edge portion 142 may be magnetically attracted to first support member 320, as indicated schematically in FIG. 7. At this point, edge portion 142 may tend to magnetically attach to first support member 320 (as well as second support member 322), so that the position of edge portion 142 on first support member 320 and second support member 322 is temporarily fixed, as shown in FIG. 8. In particular, the magnetic force may be strong enough so that as printing assembly 100 begins to move away from first support member 320 and second support member 322, edge portion 142 remains in place on first support member 320 and second support member 322. This causes screen member 140 to extend from housing member 130, as shown in FIG. 9.

Figure 10:
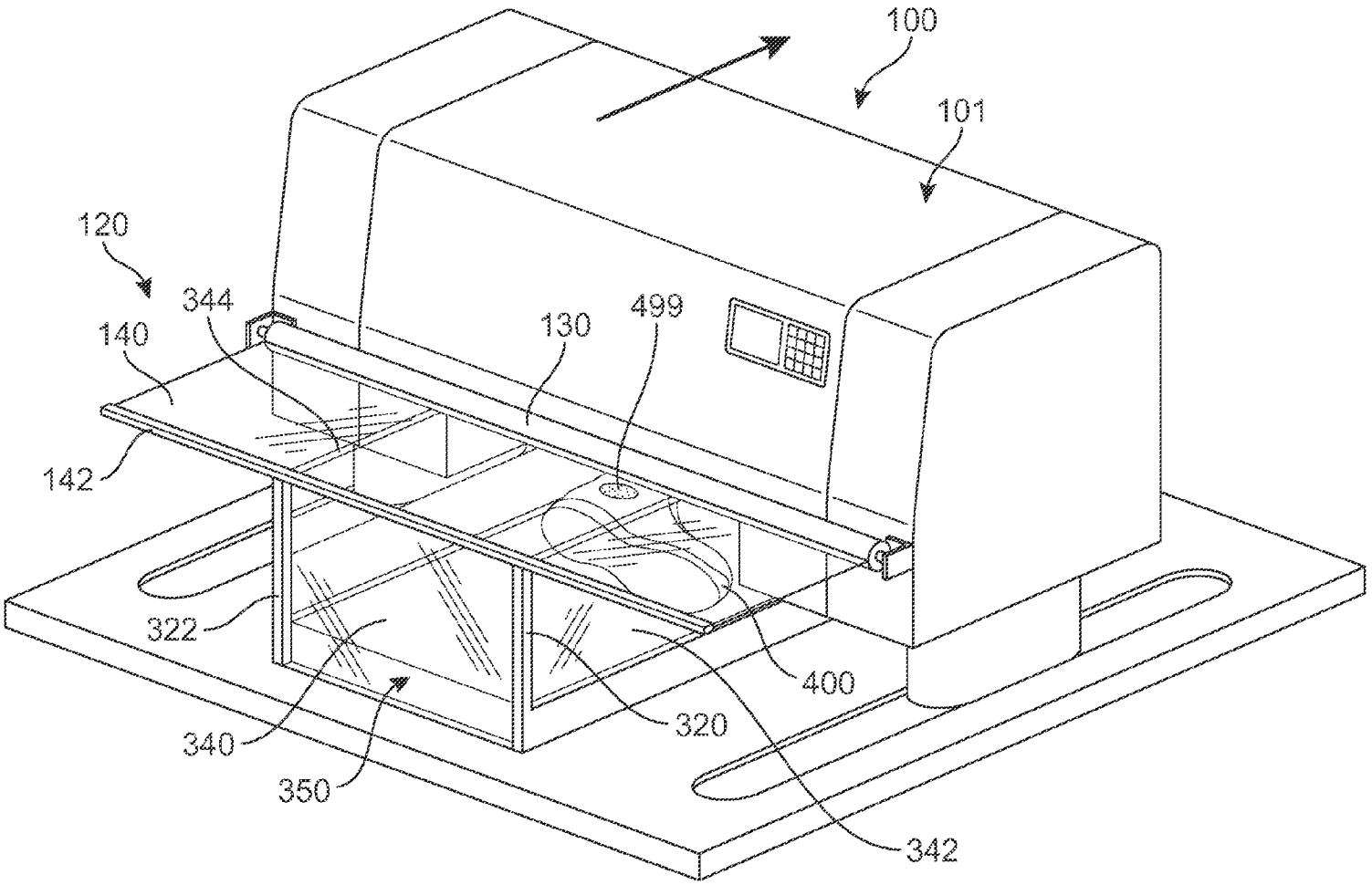
FIG. 10 is a schematic isometric view of an embodiment of a printing station, in which a screen member is extended as a printing device moves in a rearwards direction.

The extension of screen member 140 from housing member 130 is also shown in FIG. 10, which illustrates a schematic isometric view of printing assembly 100 moving away from front portion 350 of platform 304 following the temporary attachment of edge portion 142 to first support member 320 and second support member 322. Referring to FIG. 10, it can be seen that as screen member 140 is extended from housing 130, screen member 140 acts to cover upper opening 340 (see FIG. 3), thereby enclosing the region bounded by front wall 340, first side wall 342, second side wall 344 and screen member 140. Moreover, as printing device 101 may apply ink and UV curing to article 400 while passing from front portion 350 of platform 304 towards a rearward most position, screen member 140 is seen to provide UV protection during this stage of printing. For purposes of illustration, a printed graphic 499 is seen in FIGS. 10-13, which has been printed onto article 400 using ink and UV curing.

Figure 11:
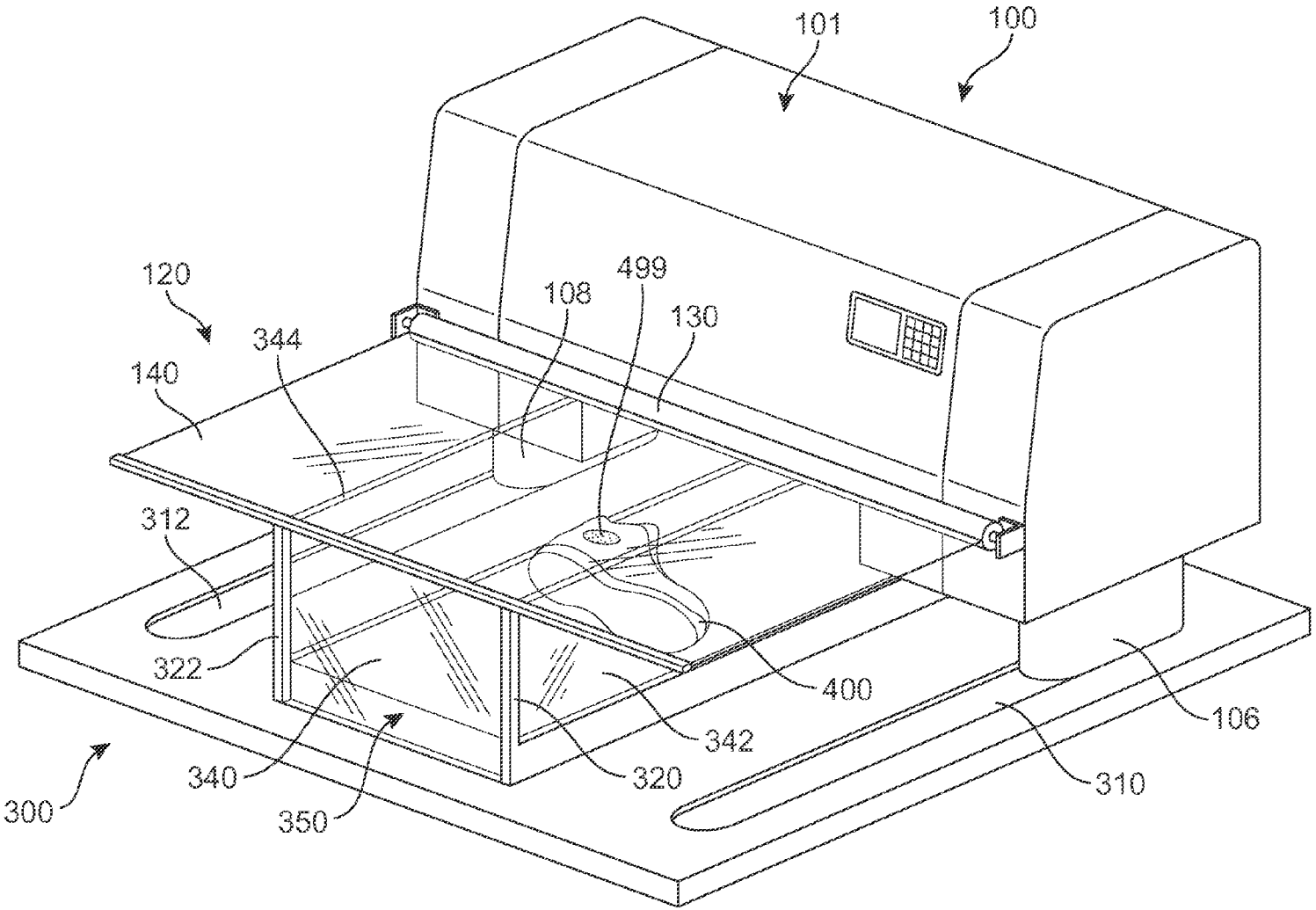
FIG. 11 is a schematic isometric view of an embodiment of a printing station, in which a screen member has fully extended.

FIG. 11 shows a final stage in which screen member 140 has been fully extended to cover upper opening 340 (see FIG. 3) of platform 304. Thus it can be seen that as the position of printing device 101 varies with respect to platform 304, the protective area provided by screen member 140 increases accordingly.

Figure 12:
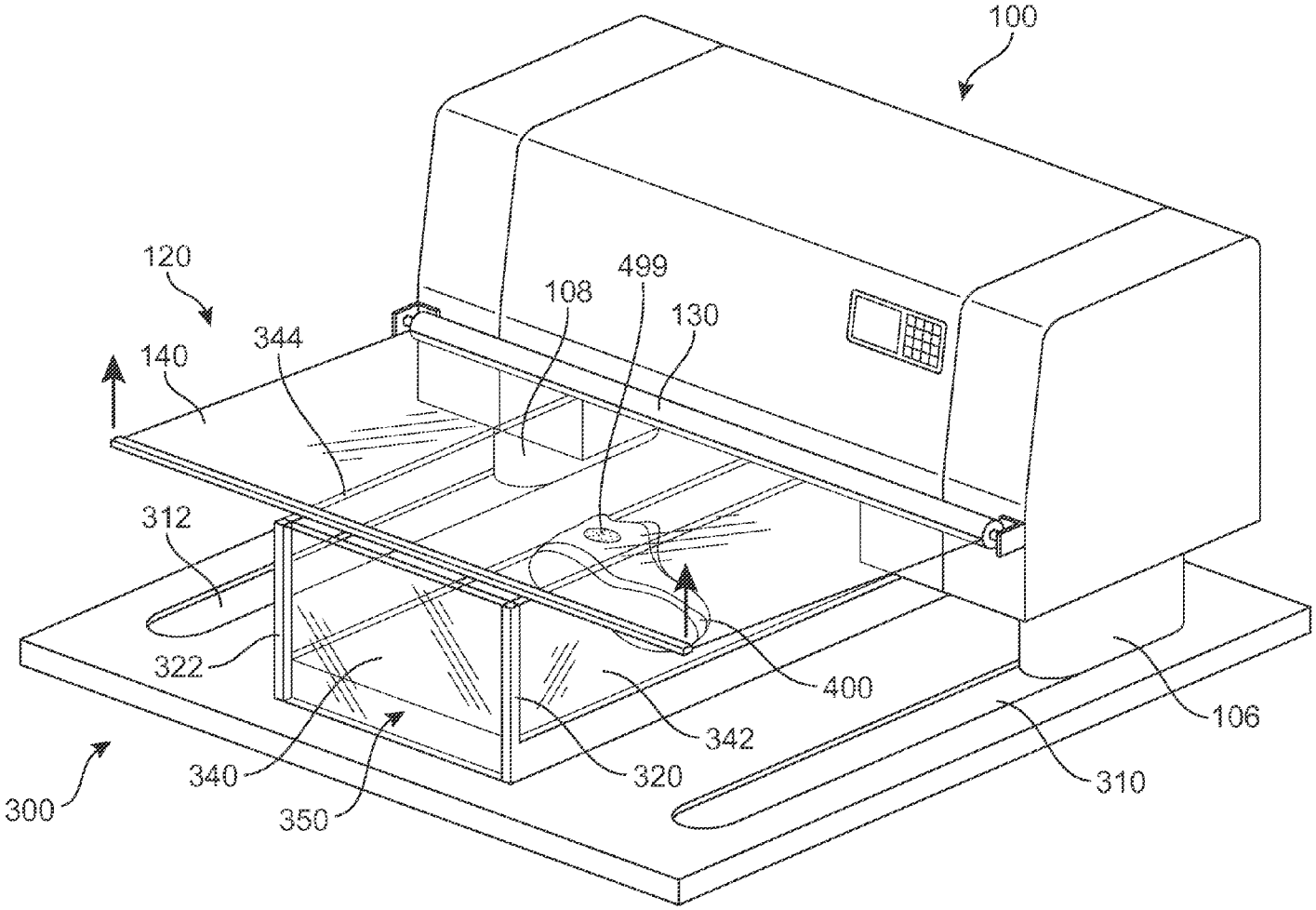
FIG. 12 is a schematic isometric view of an embodiment of a printing station, in which a screen member has been detached from two support members.
Figure 13:
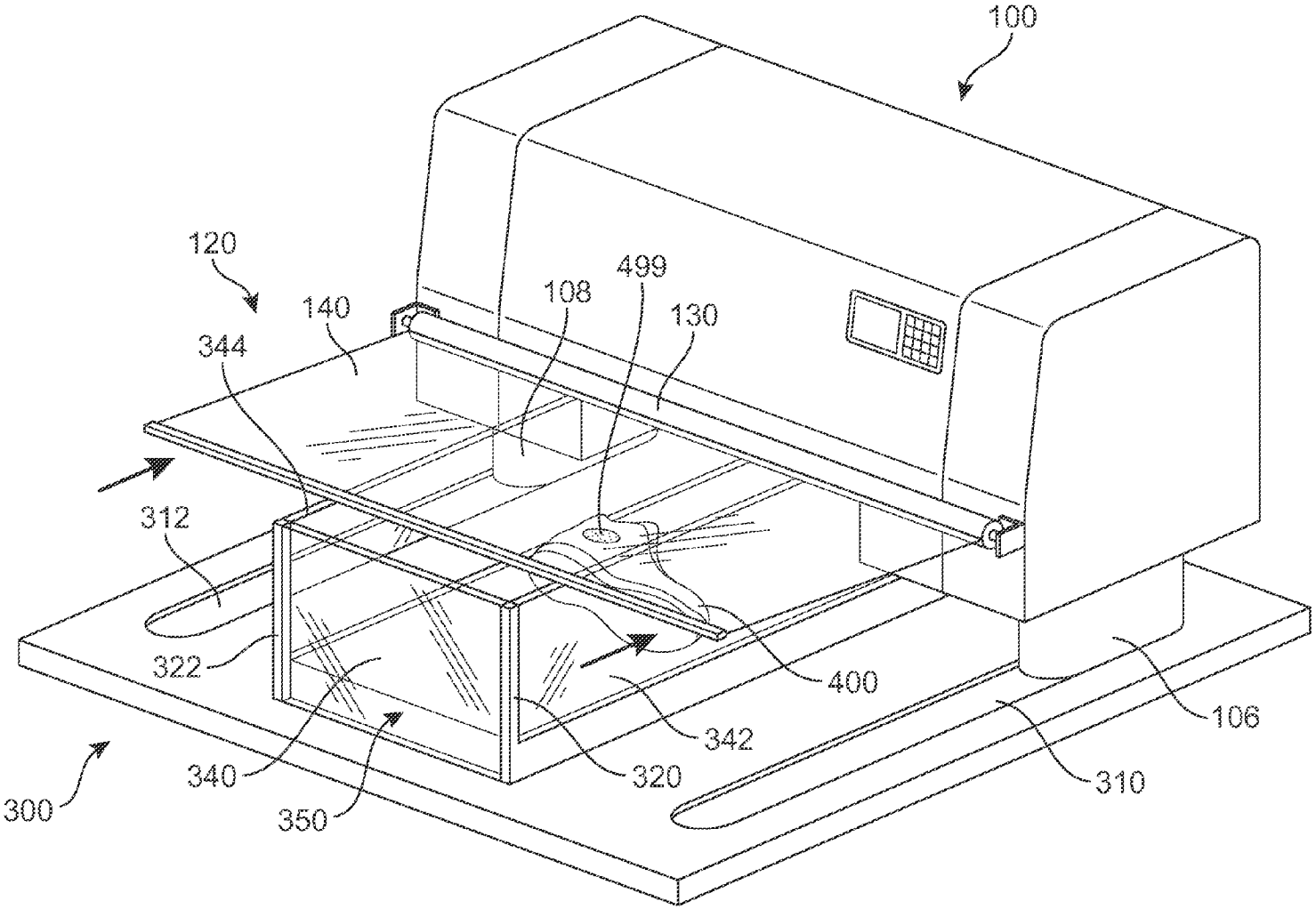
FIG. 13 is a schematic isometric view of an embodiment of a screen member retracting into a housing member.
Figure 14:
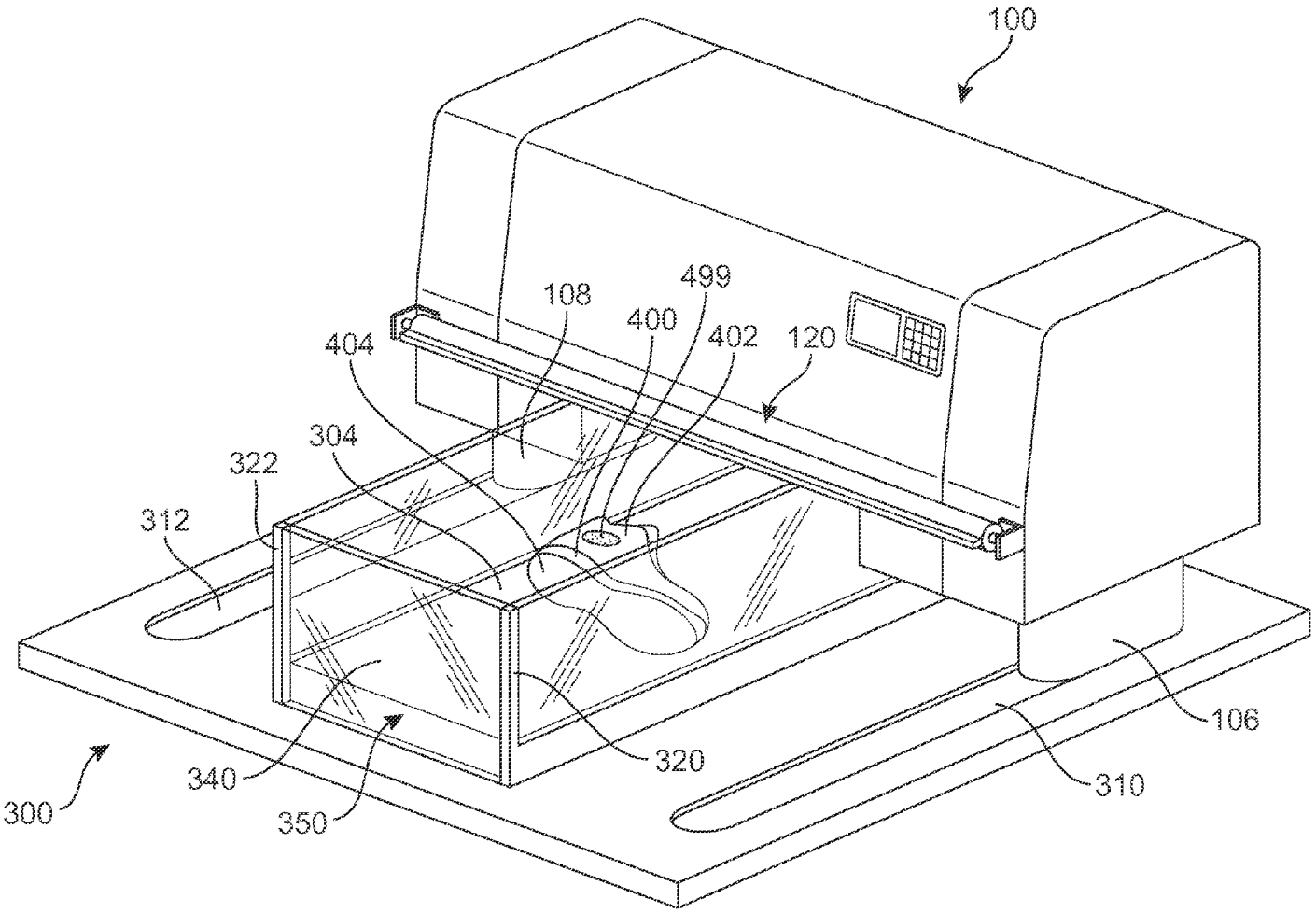
FIG. 14 is a schematic isometric view of an embodiment of the screen member of FIG. 13 in a fully retracted position.

Once the printing process has been completed, and especially after the UV light source has been turned off, screen member 140 can be disengaged from first support member 320 and second support member 322. In some embodiments, this can be accomplished by simply lifting first edge portion 142 upwardly, as seen in FIG. 12, and then allowing screen member 140 to retract into housing member 130, as seen in FIGS. 13 and 14.

Figure 15:
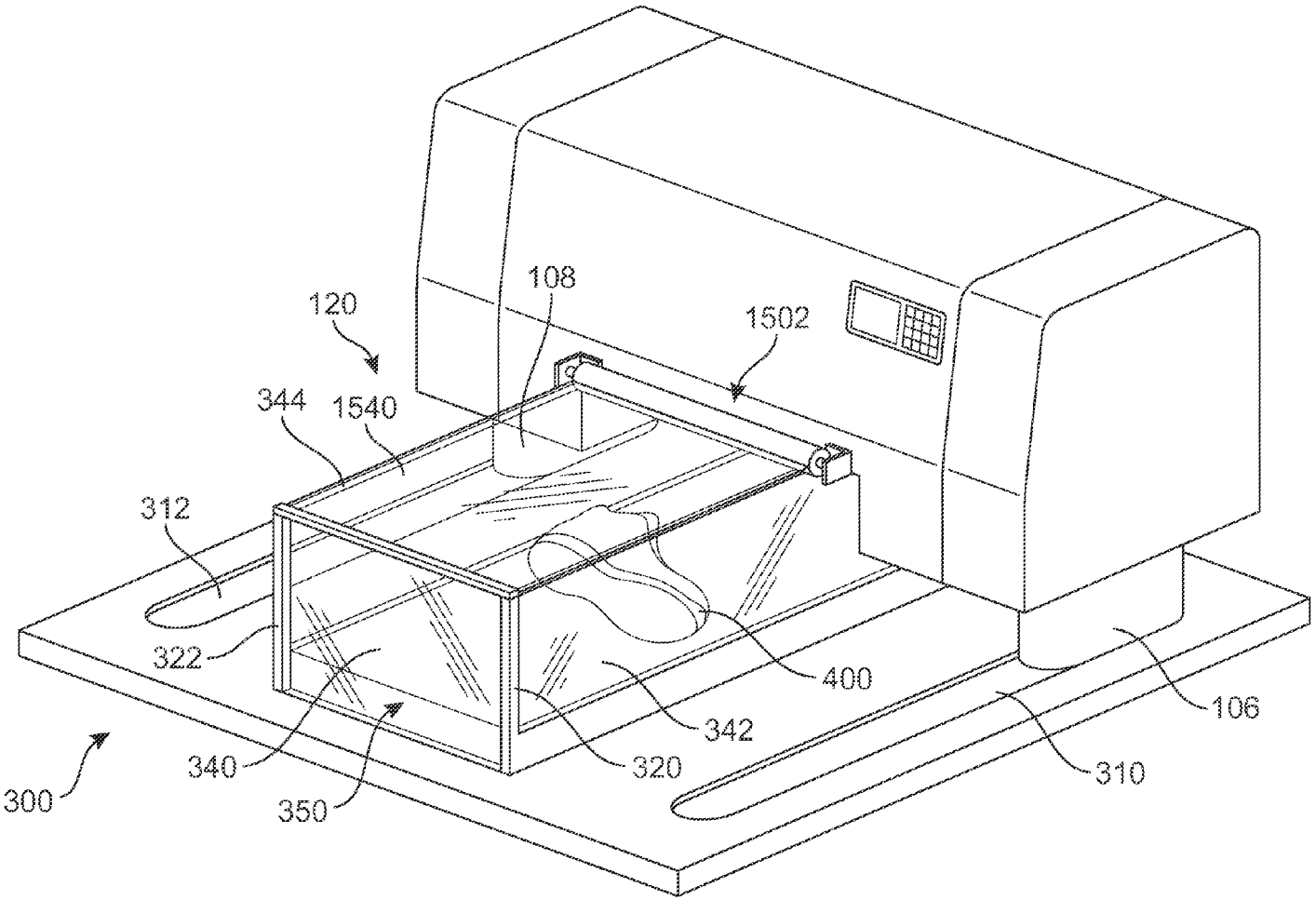
FIG. 15 is a schematic isometric view of another embodiment of a printing station with a retractable screen assembly.

Alternate embodiments are also possible. For example, FIG. 15 illustrates in embodiment in which a retractable screen assembly 1502 is sized to fit over upper opening 340. In particular, in some embodiments, the length of retractable screen assembly 1502 may be approximately similar to the spacing between first side wall 342 and second side wall 344. In this configuration, screen member 1540 may cover upper opening 340 without substantially extending beyond the boundaries of first side wall 342 and second side wall 344.

Figure 16:
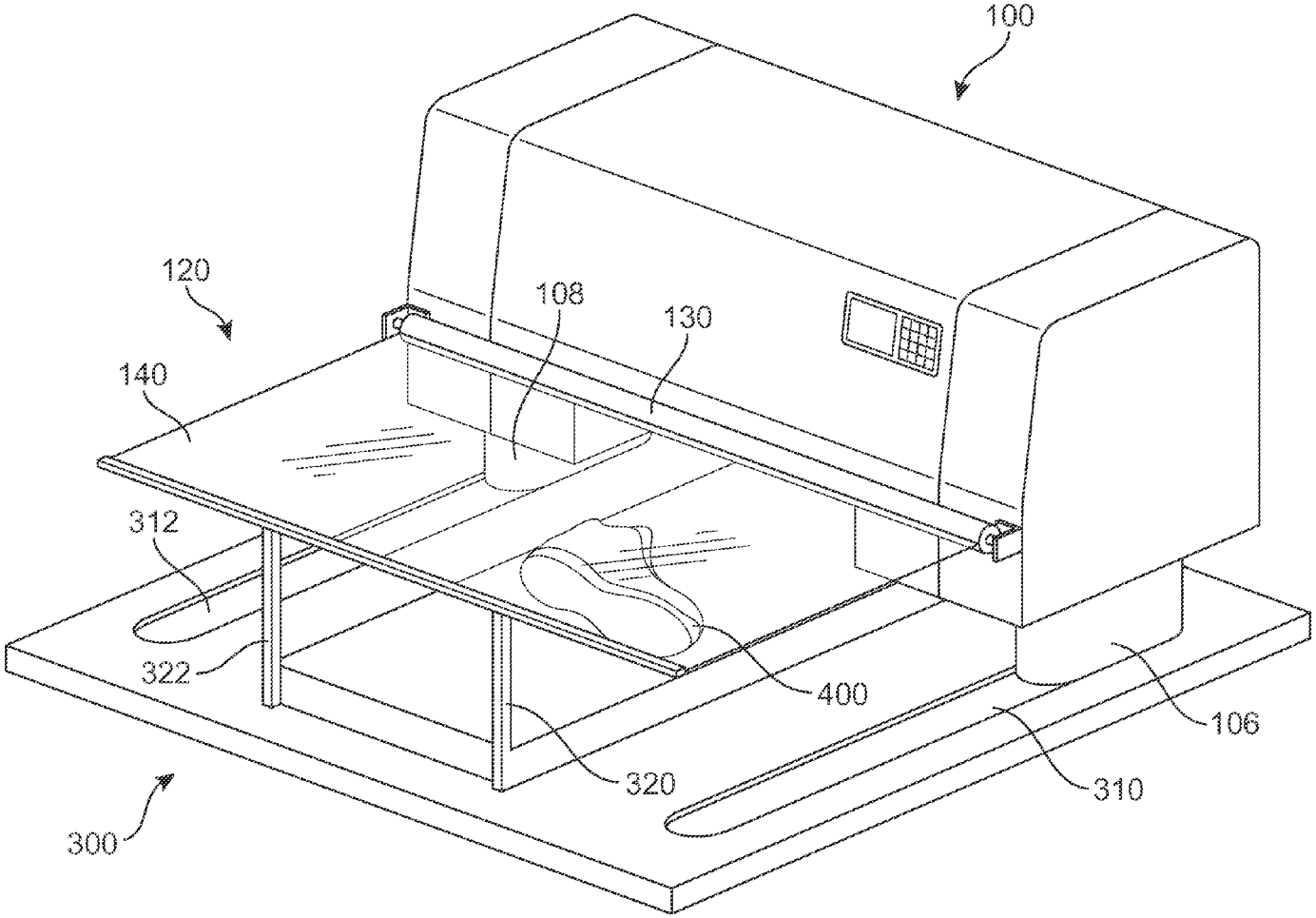
FIG. 16 is a schematic isometric view of another embodiment of a printing station with a retractable screen assembly.

In still other embodiments, as shown in FIG. 16, it may be possible to use screen member 140 without any of front wall 340, first side wall 342 and/or second side wall 344. Such embodiments may still effectively block UV light along the direct viewing angles of operators and/or persons in the vicinity of printing station 300. In still further embodiments, one or more walls or other protective screens can be placed around the perimeter of table 302. In such an embodiment, when screen member 142 extends, the enclosed region may comprise a large region of table 302, rather than a region associated with platform 304.

FIGS. 17 through 21 illustrate an alternative configuration for a printing station 1700 and printing assembly 1710. Printing assembly 1710 includes printing device 1701 as well as retractable screen assembly 1720, which may be similar in some respects to printing device 301 and retractable screen assembly 120 of the previous embodiments.

Printing station 1700 may include printing table 1702, which supports printing assembly 1710 as well as other components. Printing station 1700 can also include platform 1704. As in previous embodiments, platform 1704 could incorporate a first support member 1730 and a second support member 1732, which may interact with retractable screen assembly 1720. Further, platform 1704 may be associated with a front wall 1740, a first side wall 1742 and a second side wall 1744. Each of front wall 1740, first side wall 1742 and second side wall 1744 could be made of a UV protective material. Moreover, it will be understood that in other embodiments any of first support member 1730, second support member 1732, front wall 1740, first side wall 1742 and/or second side wall 1744 could be optional.

In contrast to previous embodiments, the present embodiment may be configured with provisions to keep the position of printing device 1701 fixed, while translating platform 1704 and associated components across table 1702 in order to position articles in place beneath printing device 1701. For purposes of clarity, platform 1704, first support member 1730, second support member 1732, front wall 1740, first side wall 1742 and second side wall 1744 may be collectively referred to as platform assembly 1750.

Figure 18:
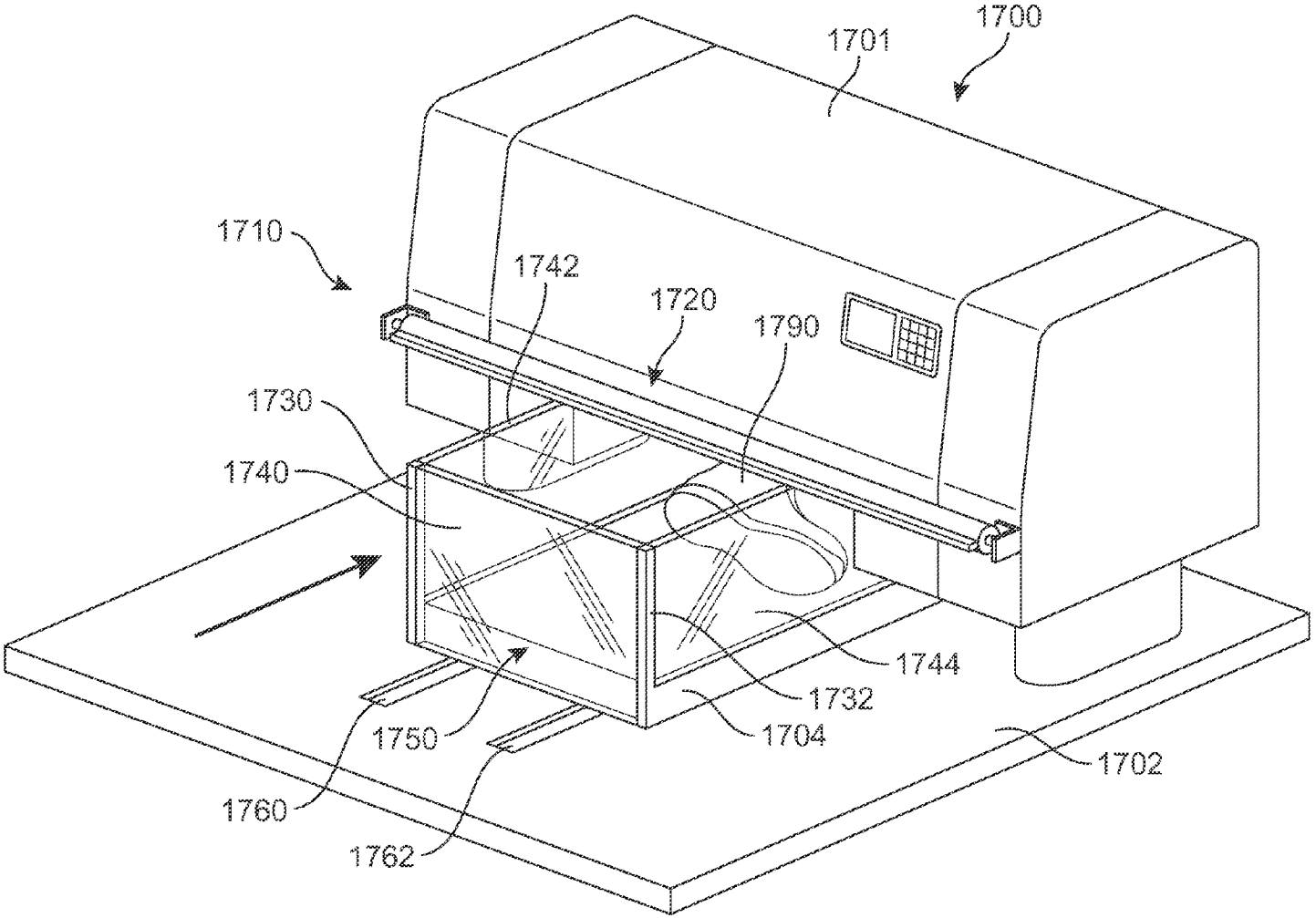
FIG. 18 is a schematic isometric view of the printing station of FIG. 17, in which the platform assembly has moved towards the printing device.

As seen in FIG. 18, for example, table 1702 may be configured with first track 1760 and second track 1762 that may engage corresponding features on a lower surface of platform 1704 (not shown). In particular, platform 1704, and more generally the components of platform assembly 1750, may translate along first track 1760 and second track 1762. Different provisions could be used for moving one or more components of platform assembly 1750 across table 1702 (and therefore, relative to printing device 1701). Such provisions may be well known in the art and can include, but are not limited to: gear based systems, chain based systems, manually controlled systems, automatically controlled systems as well as any other kinds of systems. Although the current embodiment illustrates tracks for facilitating the motion of platform assembly 1750, other embodiments may not utilize tracks. In some other embodiments, provisions for moving platform assembly 1750 may be incorporated directly into printing device 1701, such as provisions already known in the art for automatically positioning trays, or similar components, with respect to the print heads of a printer. It should be further understood that all embodiments of the present disclosure could utilize any methods of movement, and are not limited to track-based systems shown schematically in the Figures.

Figure 17:
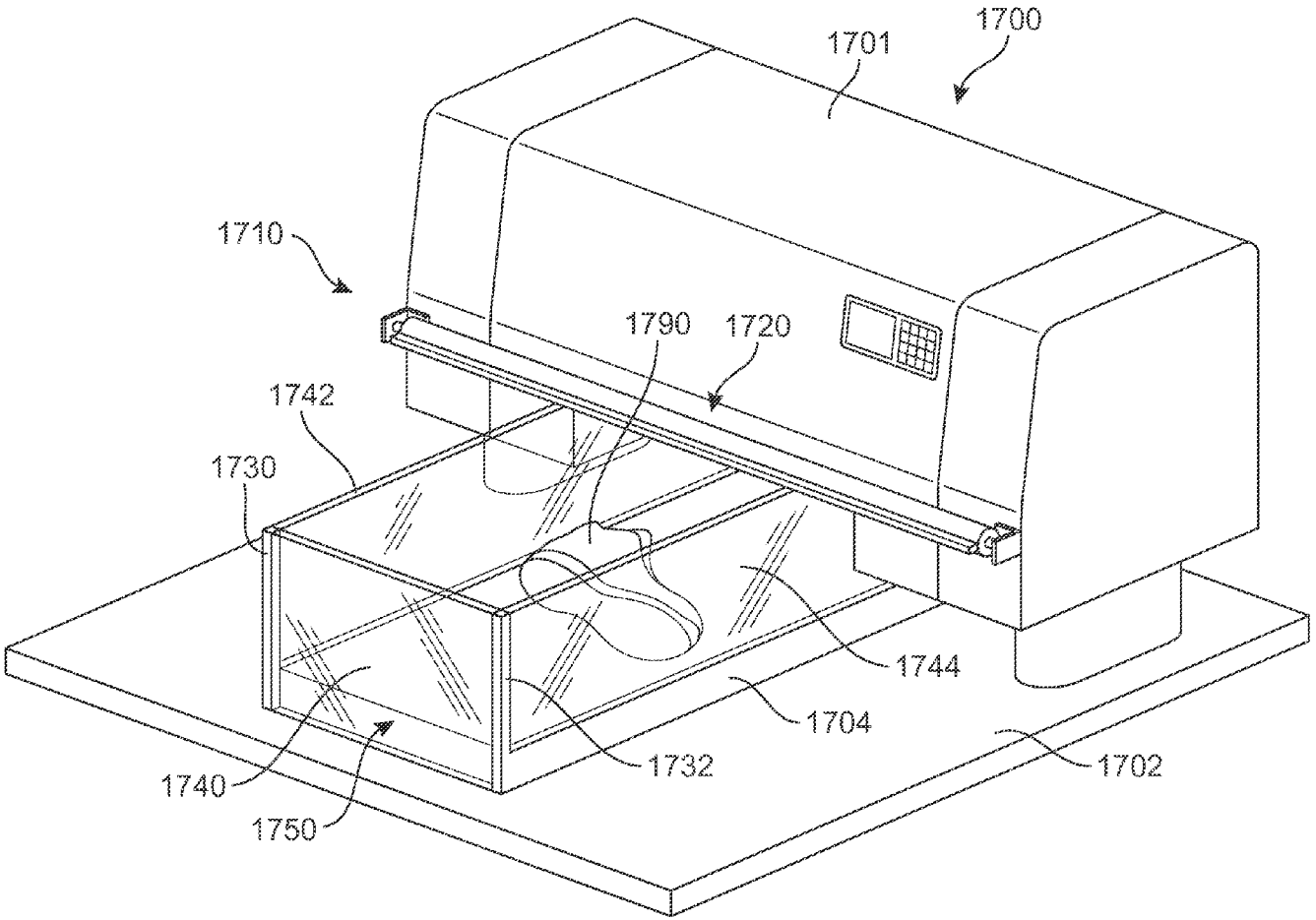
FIG. 17 is a schematic isometric view of another embodiment of a printing station in which a platform assembly can move with respect to a printing assembly.
Figure 19:
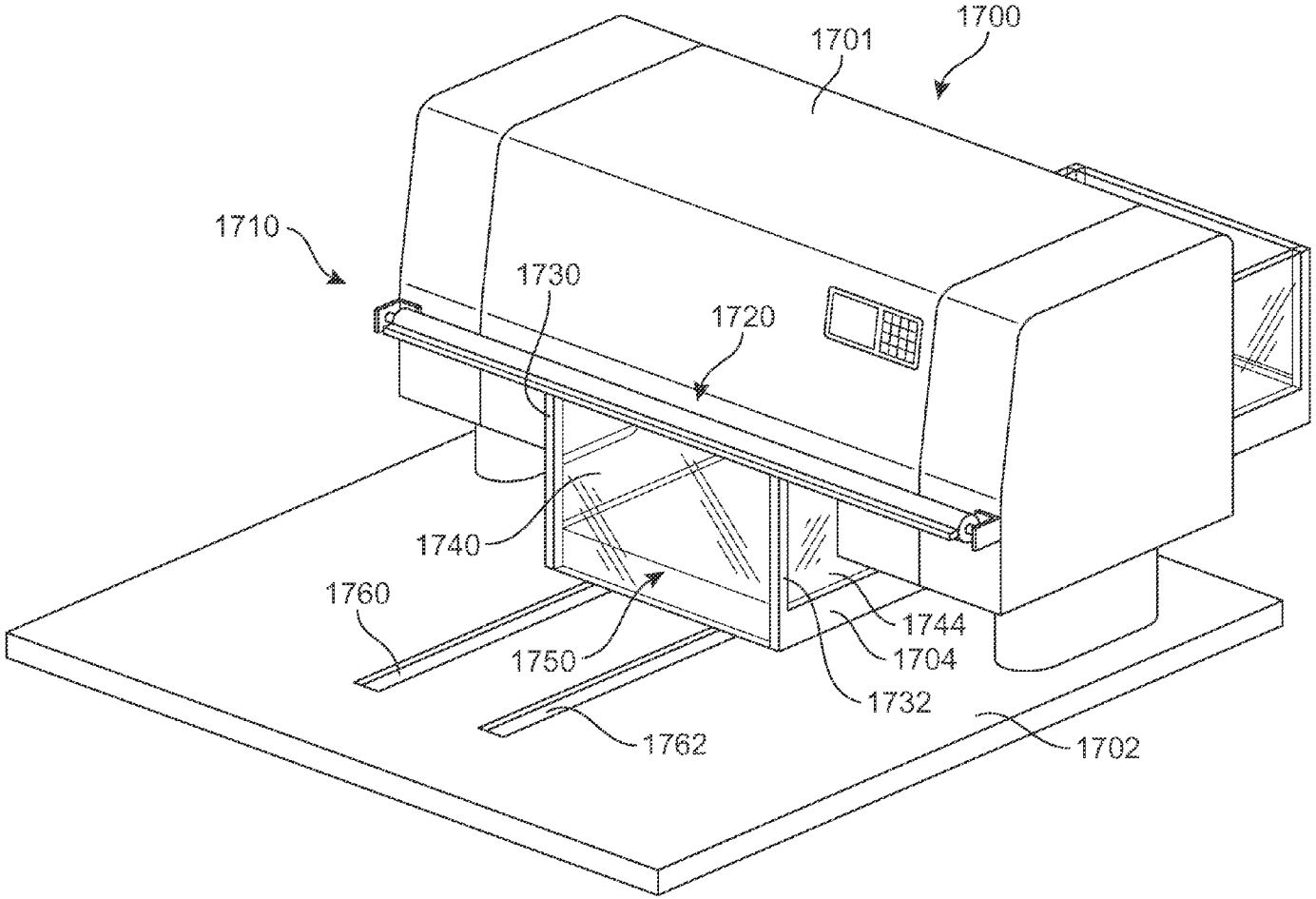
FIG. 19 is a schematic isometric view of the printing station of FIG. 17, in which the platform assembly has moved to a rearward most position.
Figure 20:
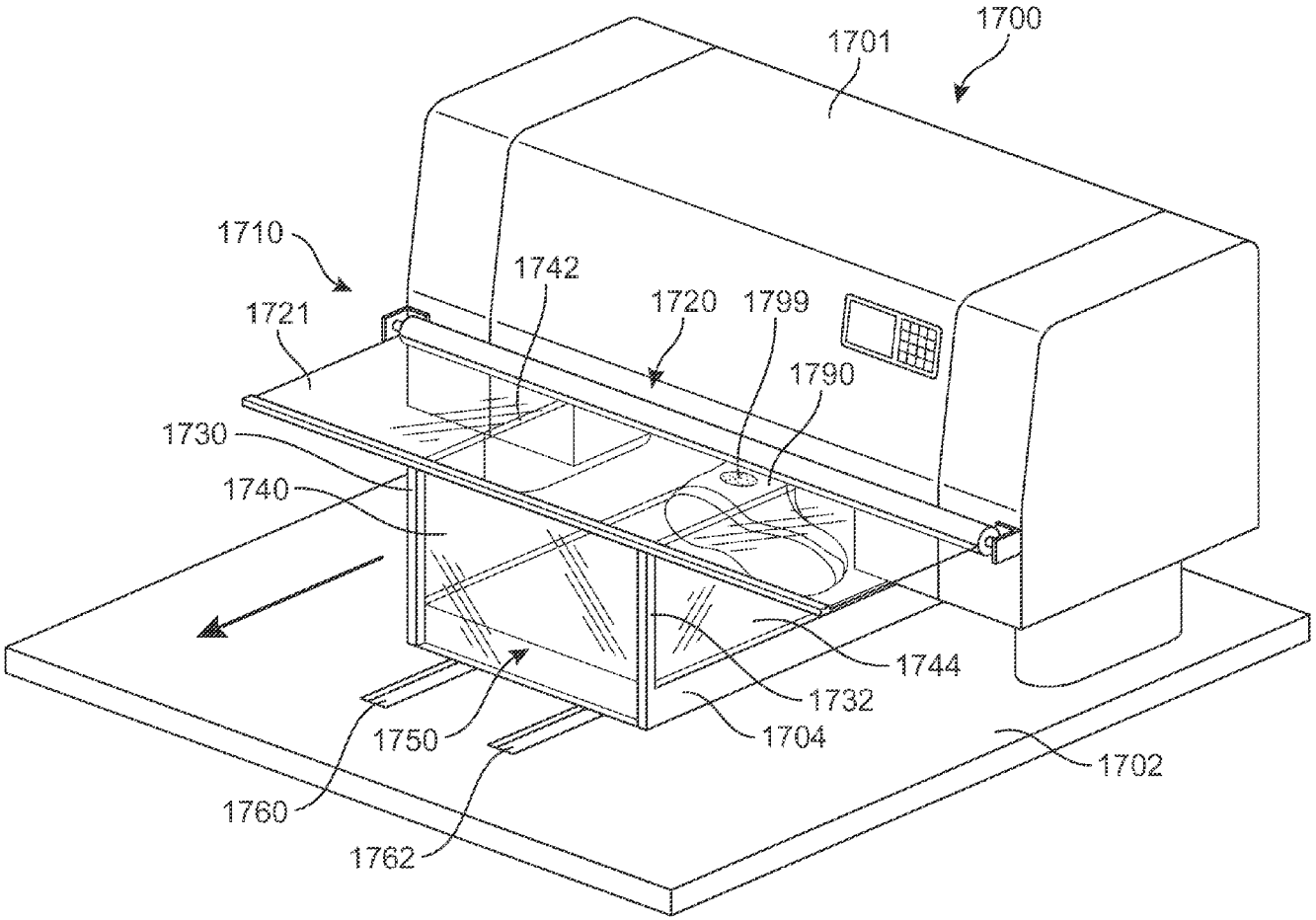
FIG. 20 is a schematic isometric view of the printing station of FIG. 17, in which a screen is partially extended.
Figure 21:
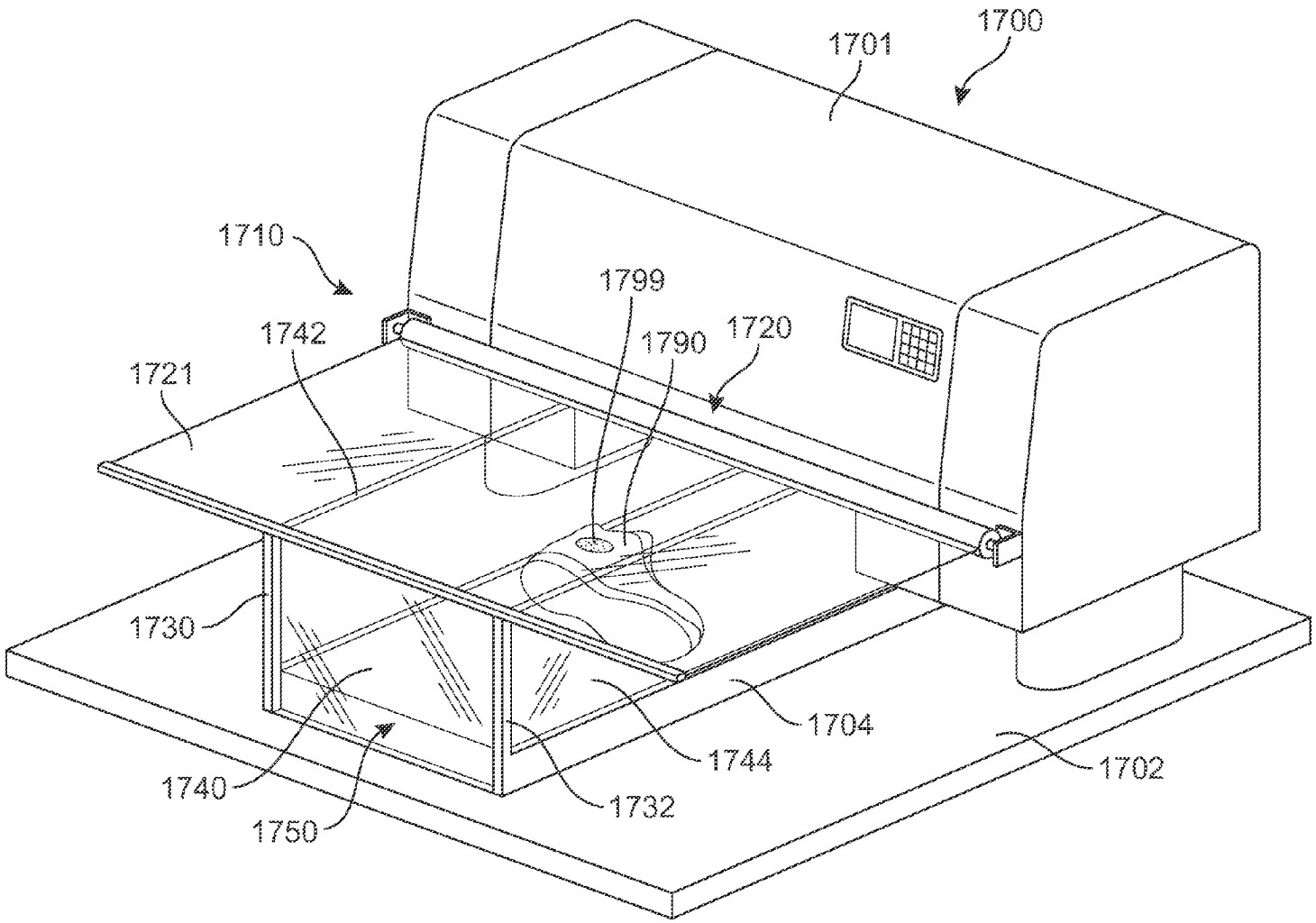
FIG. 21 is a schematic isometric view of the printing station of FIG. 17, in which a screen is fully extended.

Using this configuration, the process of engaging retractable screen assembly 1720 and moving an article disposed on platform 1704 into position for printing comprises moving platform assembly 1750 through a sequence of positions as shown in FIGS. 17 through 21. In particular, article 1790 may be placed onto platform assembly 1750, which may extend forwardly from printing device 1701, as seen in FIG. 17. At this point, retractable screen assembly 1720 may not be engaged with platform assembly 1750. In FIG. 18, platform assembly 1750 moves towards printing device 1701, until retractable screen assembly 1720 engages one or more portions of platform assembly 1750 (e.g., first support member 1730 and second support member 1732), as seen in FIG. 19. With retractable screen assembly 1720 engaged with platform assembly 1750, screen member 1721 extends with platform assembly 1750, as seen in FIGS. 20 and 21. Also shown in FIGS. 20 and 21 is a printed graphic 1799 that has been printed onto article 1790 using ink and UV curing. This arrangement helps prevent UV light from escaping the region bounded by front wall 1740, first side wall 1742, second side wall 1744 and screen 1721 (which covers the top of the region) during the printing process.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A printing assembly, comprising:

a printing device;

a retractable screen assembly fastened to the printing device, the retractable screen assembly further comprising: a housing member and a screen member that can extend from and retract into the housing member;

a platform disposed adjacent to the printing device, wherein the platform is configured to move relative to the printing device; and wherein the screen member extends from the housing member while the printing device is in use.

2. The printing assembly according to claim 1, wherein the printing device includes a UV light source.

3. The printing assembly according to claim 2, wherein the screen member is a UV protective screen.

4. The printing assembly according to claim 3, wherein the screen member is substantially transparent.

5. The printing assembly according to claim 1, wherein the retractable screen assembly is biased to retract within the housing member.

6. The printing assembly according to claim 1, wherein the printing device includes a top portion and a bottom portion, wherein the printing device includes an opening on the bottom portion for receiving articles to be printed, and wherein the retractable screen assembly is attached to the printing device between the top portion of the printing device and the opening.

7. The printing assembly according to claim 1, wherein the platform moves while the printing device remains stationary relative to the platform, and wherein the screen member extends from the housing member to a portion of the platform as the platform is moved away from the printing device.

8. A flexible manufacturing system, comprising:

a printing assembly with a printing device and a retractable screen assembly;

the retractable screen assembly further comprising: a housing member fastened to the printing device and a screen member that can extend from and retract into the housing member;

a support member disposed adjacent to the printing assembly, wherein the printing assembly is configured to move relative to the support member;

wherein a portion of the screen member can be releasably fastened to the support member.

9. The flexible manufacturing system according to claim 8, wherein the portion of the screen member is an edge portion.

10. The flexible manufacturing system according to claim 8, wherein the support member is a post.

11. The flexible manufacturing system according to claim 8, wherein the portion of the screen member is magnetically fastened to the support member.

12. The flexible manufacturing system according to claim 8, wherein the portion of the screen member is mechanically fastened to the support member.

13. The flexible manufacturing system according to claim 8, wherein the screen member is biased to retract within the housing member.

14. The flexible manufacturing system according to claim 8, wherein the screen member can cover an upper opening formed by a front wall, a first side wall and a second side wall that extend around a platform of the flexible manufacturing system.

15. A flexible manufacturing system, comprising:

a printing assembly with a printing device and a retractable screen assembly;

the retractable screen assembly further comprising: a housing member fastened to the printing device and a screen member that can extend from and retract into the housing member;

a support member disposed adjacent to the printing assembly, wherein the printing assembly is configured to move relative to the support member;

wherein a portion of the screen member can automatically fasten to the support member when the printing device is moved directly adjacent to the support member and while the screen member is retracted within the housing; and wherein the screen member extends from the housing as the printing device is moved away from the support member and while the portion remains fastened to the support member.

16. The flexible manufacturing system according to claim 15, wherein the retractable screen assembly has a length that is approximately equal to a length of the printing device.

17. The flexible manufacturing system according to claim 15, wherein the retractable screen assembly has a length that is substantially less than a length of the printing device.

18. The flexible manufacturing system according to claim 15, wherein the screen member is made of a UV protective material.

19. The flexible manufacturing system according to claim 15, wherein the screen member is substantially flexible.

20. The flexible manufacturing system according to claim 15, wherein the screen member can be detached from the support member by lifting an edge of the screen member.

21. The flexible manufacturing system according to claim 15, wherein the printing device moves along a platform and wherein the platform is surrounded by walls of UV protective material.

* * * * *